US010748492B2

(12) United States Patent
Takasugi

(10) Patent No.: US 10,748,492 B2
(45) Date of Patent: Aug. 18, 2020

(54) GATE SHIFT REGISTER AND ORGANIC LIGHT EMITTING DISPLAY APPARATUS INCLUDING THE SAME

(71) Applicant: LG Display Co., Ltd., Seoul (KR)

(72) Inventor: Shinji Takasugi, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 16/208,243

(22) Filed: Dec. 3, 2018

(65) Prior Publication Data

US 2019/0180691 A1 Jun. 13, 2019

(30) Foreign Application Priority Data

Dec. 11, 2017 (KR) ..... 10-2017-0169638

(51) Int. Cl.
*G09G 3/3266* (2016.01)

(52) U.S. Cl.
CPC ... *G09G 3/3266* (2013.01); *G09G 2310/0286* (2013.01); *G09G 2310/06* (2013.01)

(58) Field of Classification Search
CPC combination set(s) only.
See application file for complete search history.

(56) References Cited

U.S. PATENT DOCUMENTS

2014/0093027 A1* 4/2014 Jang ..... G11C 5/005 377/64
2014/0321599 A1* 10/2014 Cho ..... G11C 19/28 377/64

* cited by examiner

*Primary Examiner* — Deeprose Subedi
(74) *Attorney, Agent, or Firm* — Seed IP Law Group LLP

(57) ABSTRACT

Provided is a gate shift register having multiple stages including a plurality of scan clock lines supplying scan shift clocks having different phases required for generating a scan control signal to the stages, and a plurality of shared carry clock lines supplying carry shift clocks having different phases required for generating a carry signal to the stages, wherein the number of the shared carry clock lines is half of the number of the scan clock lines and each of stage pairs including an odd-numbered stage and an even-numbered stage adjacent to each other share one carry shift clock.

20 Claims, 22 Drawing Sheets

GATE SHIFT REGISTER AND ORGANIC LIGHT EMITTING DISPLAY APPARATUS INCLUDING THE SAME

CROSS-REFERENCE TO RELATED APPLICATION(S)

This application claims the benefit of Korea Patent Application No. 10-2017-0169638, filed Dec. 11, 2017, which is incorporated herein by reference for all purposes as if fully set forth herein.

BACKGROUND

Technical Field

The present disclosure relates to a shift register and an organic light emitting display apparatus including the same.

Description of the Related Art

An active matrix type organic light emitting display apparatus includes a self-luminous organic light emitting diode (OLED) and advantageously has a fast response speed, high luminous efficiency, high luminance, and a wide viewing angle.

An OLED, a self-luminous device, includes an anode electrode, a cathode electrode, and organic compound layers (a hole injection layer (HIL), a hole transport layer (HTL), an emission layer (EML), an electron transport layer (ETL), and an electron injection layer (EIL)) formed therebetween. The organic compound layers include the HIL, HTL, EML, ETL, and EIL. When a driving voltage is applied to the anode electrode and the cathode electrode, holes which have passed through the HTL and electrons which have passed through the ETL move to the EML to form an excitons, resultantly causing the EML to emit visible light.

In an organic light emitting display apparatus, pixels each including an OLED are arranged in a matrix form and luminance of pixels are adjusted according to gradation of image data. Each of the pixels includes a driving element (or a driving transistor) controlling a driving current flowing in the OLED, a plurality of switching elements for programming a gate-source voltage of the driving element, and at least one storage capacitor.

An organic light emitting display apparatus includes a gate driver for driving switching elements provided in pixels. Gate electrodes of the switching elements are connected to the gate driver through gate lines. The gate driver generates a gate signal and sequentially supplies the gate signal to the gate lines. The gate signal swings between a gate high voltage at which the switching elements may be turned on and a gate low voltage at which the switching elements may be turned off. The gate driver may be implemented as a gate shift register including a plurality of stages.

Multiple shift clocks are required for the stages to operate. The shift clocks are a plurality of pulses which are sequentially shifted in phase and which swing between the gate high voltage and the gate low voltage. The shift clocks may include scan shift clocks and carry shift clocks, and may further include sensing shift clocks. The scan shift clocks are for generating a scan control signal, the carry shift clocks are for generating a carry signal, and the sensing shift clocks are for generating a sensing control signal.

A scan control signal may be output as a gate high voltage in synchronization with the scan shift clocks. When the switching element in a pixel is turned on according to the scan control signal having the gate high voltage, a data voltage for displaying an image is written to the pixel. Meanwhile, the carry signal may be output as the gate high voltage in synchronization with the carry shift clocks. An operation of a corresponding stage may be activated according to the carry signal of the gate high voltage. The sensing control signal may be output as a gate high voltage in synchronization with the sensing shift clocks. When the switching element in the pixel is turned on according to the sensing control signal of the gate high voltage, the reference voltage for displaying an image is written to the pixel.

The shift clocks are supplied to stages via clock lines. Therefore, a large number of clock lines are required if the shift clocks are classified as clocks for scanning, carrying, or sensing purposes. The gate shift register may be formed directly in the bezel region of the display panel, and in this case, an increase in the number of clock lines may make it difficult to reduce the bezel region.

Meanwhile, in order to realize a narrow bezel, the clock lines are placed close to each other on the display panel, which increases parasitic capacitance between the clock lines. As a result, in case where shift clocks having different phases are applied to the neighboring clock lines, the shift clocks may be distorted due to a coupling effect. Distorted shift clocks may distort a gate signal and a voltage charge timing of a pixel corresponding thereto, degrading image quality.

BRIEF SUMMARY

The present disclosure provides a gate shift register capable of realizing a narrow bezel by reducing the number of clock lines, and an organic light emitting display apparatus including the same.

The present disclosure also provides a gate shift register capable of improving image quality by minimizing distortion of shift clocks due to a coupling effect between clock lines, and an organic light emitting display apparatus including the same.

In an aspect, a gate shift register having multiple stages include: a plurality of scan clock lines supplying scan shift clocks having different phases required for generating a scan control signal to the stages; and a plurality of shared carry clock lines supplying carry shift clocks having different phases required for generating a carry signal to the stages, wherein the number of the shared carry clock lines is half of the number of the scan clock lines and each of stage pairs including an odd-numbered stage and an even-numbered stage adjacent to each other share one carry shift clock.

DETAILED DESCRIPTION

Figure 1:
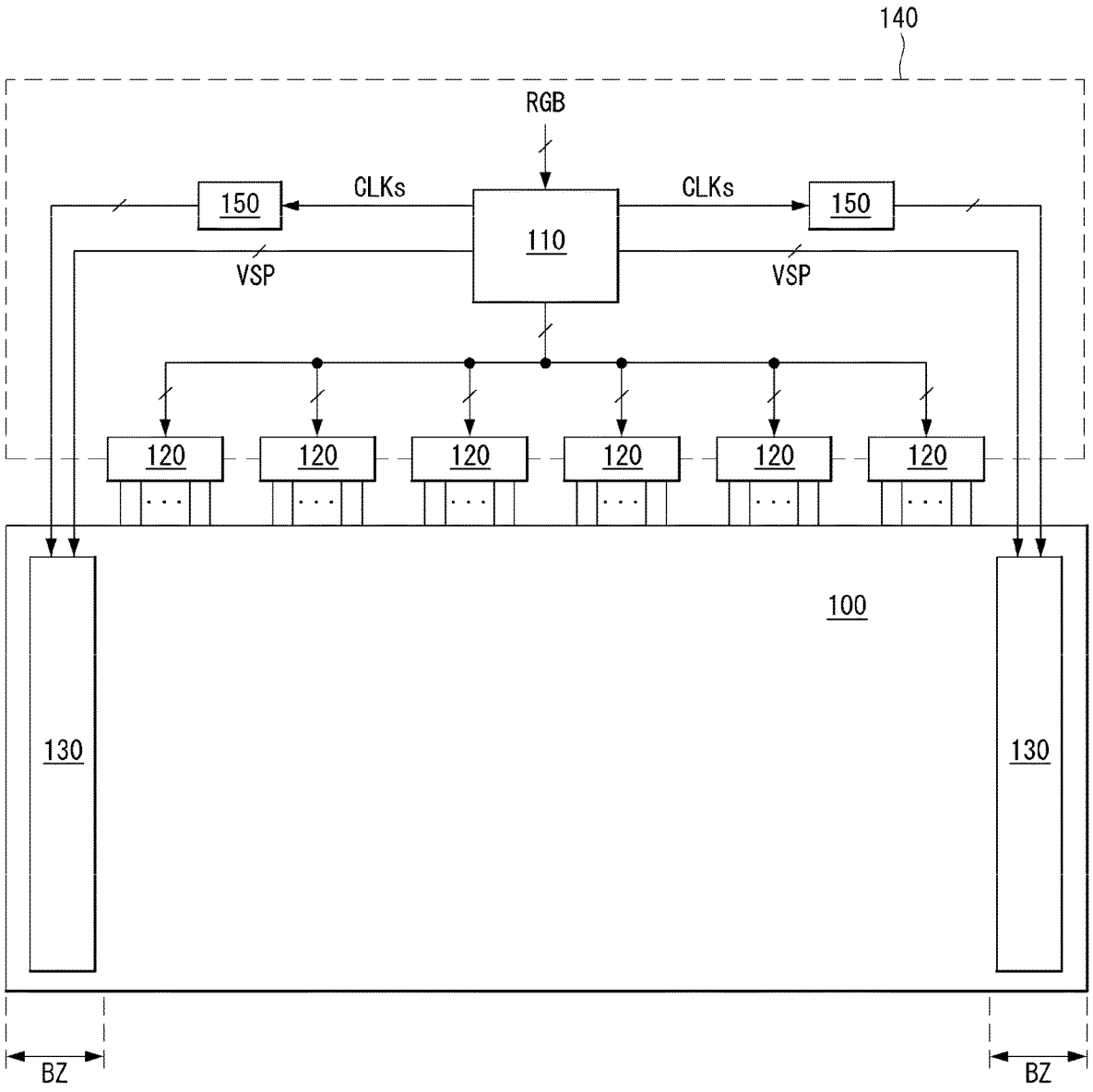
FIG. 1 illustrates an organic light emitting display apparatus according to an embodiment of the present disclosure.

Hereinafter, embodiments of the present disclosure will be described in detail with reference to the accompanying drawings. Throughout the specification, the like reference numerals denote the substantially same elements. In describing the present disclosure, if a detailed explanation for a related known function or construction is considered to unnecessarily divert the gist of the present disclosure, such explanation will be omitted but would be understood by those skilled in the art. Names of elements used in the following description are selected for the description purpose and may be different from those of actual products.

In the following description, "front stages" refer to stages which are positioned above a reference stage and generate gate signals advanced in phase, relative to a gate signal output from the reference stage. Also, "rear stages" refer to stages which are positioned below the reference stage and generate gate signals lagged in phase, relative to the gate signal output from the reference stage. In the following description, switching elements constituting a gate shift register of the present disclosure may be realized as at least any one of an oxide element, an amorphous silicon element, and a polysilicon element. Activating a specific node refers to charging the node with a high-potential source voltage or a corresponding voltage, and deactivating a specific node refers to discharging a potential of the node to reach a low-potential source voltage or a corresponding voltage.

In the present disclosure, a pixel circuit and a gate shift register formed on a substrate of a display panel may be implemented by a thin film transistor (TFT) having an n-type metal oxide semiconductor field effect transistor (MOSFET) structure but are not limited thereto. A TFT is a three-electrode element including a gate, a source, and a drain. The source is an electrode supplying a carrier to the transistor. In the TFT, carriers start to flow from the source. The drain is an electrode from which the carrier exits from the TFT.

FIG. 1 illustrates an organic light emitting display apparatus including a gate shift register according to an embodiment of the present disclosure.

Referring to FIG. 1, the organic light emitting display apparatus of the present disclosure includes a display panel 100, a data driving circuit (not shown), gate drivers 130 and 150, and a timing controller 110.

In the display panel 100, a plurality of data lines and a plurality of gate lines intersect each other, and pixels are arranged in a matrix form at the intersections, forming a pixel array. Each pixel may include an organic light emitting diode (OLED), a driving TFT, a storage capacitor, and at least one switching TFT. Each TFT may be implemented as a P type, an N type, or a hybrid type in which a P type and an N type are mixed. Further, a semiconductor layer of each TFT may include amorphous silicon, polysilicon, or an oxide.

The data driving circuit includes a plurality of source drive ICs 120. The source drive ICs 120 receive image data RGB from the timing controller 110. In response to a source timing control signal from the timing controller 110, the source drive ICs 120 convert the image data RGB into a gamma compensation voltage to generate a data voltage and supply the data voltage to the data lines of the display panel 100 in synchronization with gate signals. The source drive ICs 120 may be connected to the data lines of the display panel 100 through a chip-on-glass (COG) process or a tape automated bonding (TAB) process.

The gate drivers 130 and 150 include a level shifter connected between the timing controller 110 and the gate lines of the display panel 100 and a gate shift register.

The level shifter level-shifts a transistor-transistor-logic (TTL) level voltage of clock signals CLKs input from the timing controller 110 to a gate high voltage and a gate low voltage capable of switching a TFT formed in the display panel 100. The level shifter supplies level-shifted shift clocks to the gate shift register.

The gate shift register may be formed directly on a lower substrate of the display panel 100 in a gate-in-panel (GIP) substrate. In this embodiment, the gate shift register is formed on a gate-in-panel substrate. The gate shift register is formed in an area where an image is not displayed on the display panel 100 (i.e., a bezel area BZ). The gate shift register includes clock lines to which shift clocks are applied from the level shifter and a plurality of stages connected to the clock lines. An arrangement of the clock lines will be described later in detail with reference to FIGS. 7 to 22. In the GIP scheme, the level shifter may be mounted on a printed circuit board PCB 140.

The timing controller 110 receives image data RGB from an external host system through various known interface methods. The timing controller 110 may correct the image data RGB such that variations of electrical characteristics of the pixels are compensated on the basis of a sensing result based on real-time sensing, and then transmit the corrected image data to the source drive ICs 120.

The timing controller 110 receives timing signals such as a vertical synchronization signal Vsync, a horizontal synchronization signal Hsync, a data enable signal DE, a main clock MCLK, and the like, from the host system. The timing controller 110 generates a data timing control signal for controlling an operation timing of the data driving circuit with respect to a timing signal from the host system and a gate timing control signal for controlling an operation timing of the gate driver.

The gate timing control signal includes a start signal VSP, shift clocks CLKs, and the like.

The data timing control signal includes a source sampling clock SSC, a source output enable signal SOE, and the like. The source sampling clock SSC is a clock signal that controls a sampling timing of data in the source drive ICs 120 based on a rising or falling edge. The source output enable signal SOE is a signal for controlling an output timing of a data voltage.

Figure 2:
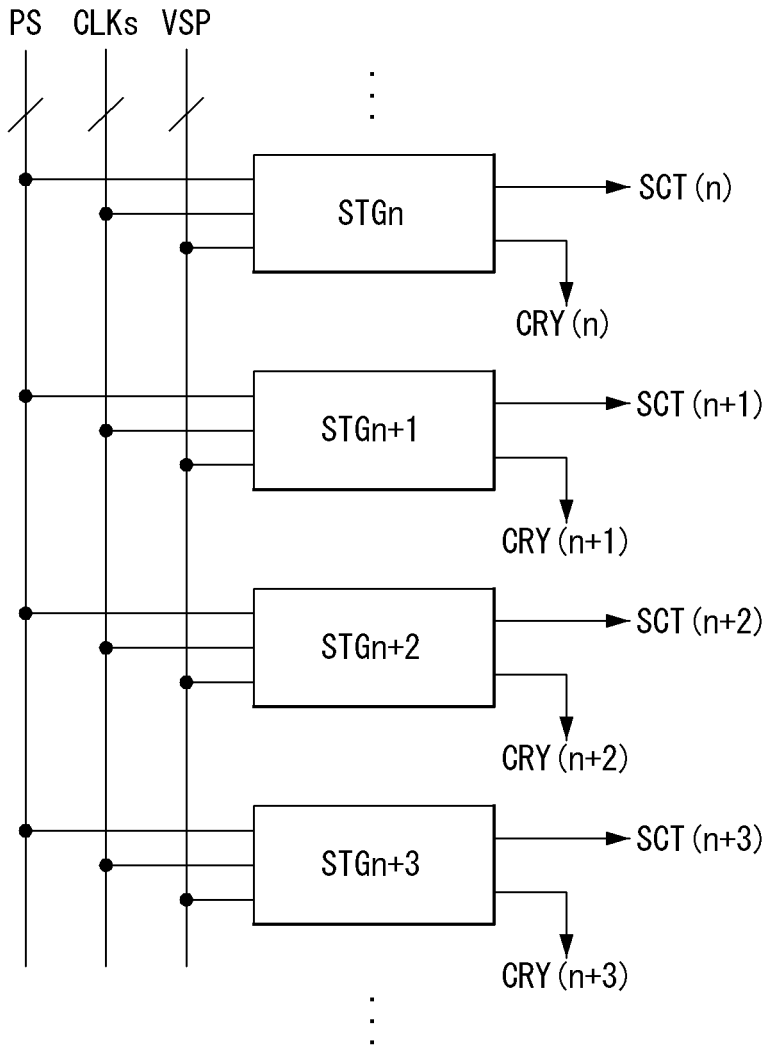
FIG. 2 illustrates a connection structure between stages constituting a gate shift register of FIG. 1.

FIG. 2 illustrates a connection structure of stages of a gate shift register included in the gate driver 130 of FIG. 1.

Referring to FIG. 2, a gate shift register according to an embodiment of the present disclosure includes a plurality of stages STGn to STGn+3 132 connected to each other dependently. The stages STGn to STGn+3 132 may be GIP elements formed on a gate-in-panel (GIP) substrate. At least one upper dummy stage may further be provided in front of an uppermost stage and at least one lower dummy stage may further be provided behind a lowermost stage.

The stages STGn to STGn+3 132 generate carry signals CRY(n) to CRY(n+3) independently of the scan control signals SCT(n) to SCT(n+3). Since the stages STGn to STGn+3 132 generate the carry signals CRY(n) to CRY(n+3) independently of the scan control signals SCT(n) to SCT(n+3), the carry signals may be prevented from being distorted by a load of the gate lines. The stages STGn to STGn+3 132 generate the scan control signals SCT(n) to SCT(n+3) and supplies the same to the gate lines of the display panel. The stages STGn to STGn+3 132 may generate the carry signals CRY(n) to CRY(n+3) and supply the carry signals as a start signal to one of the rear stages and supply the carry signals as a reset signal to any one of the front stages.

Figure 4:
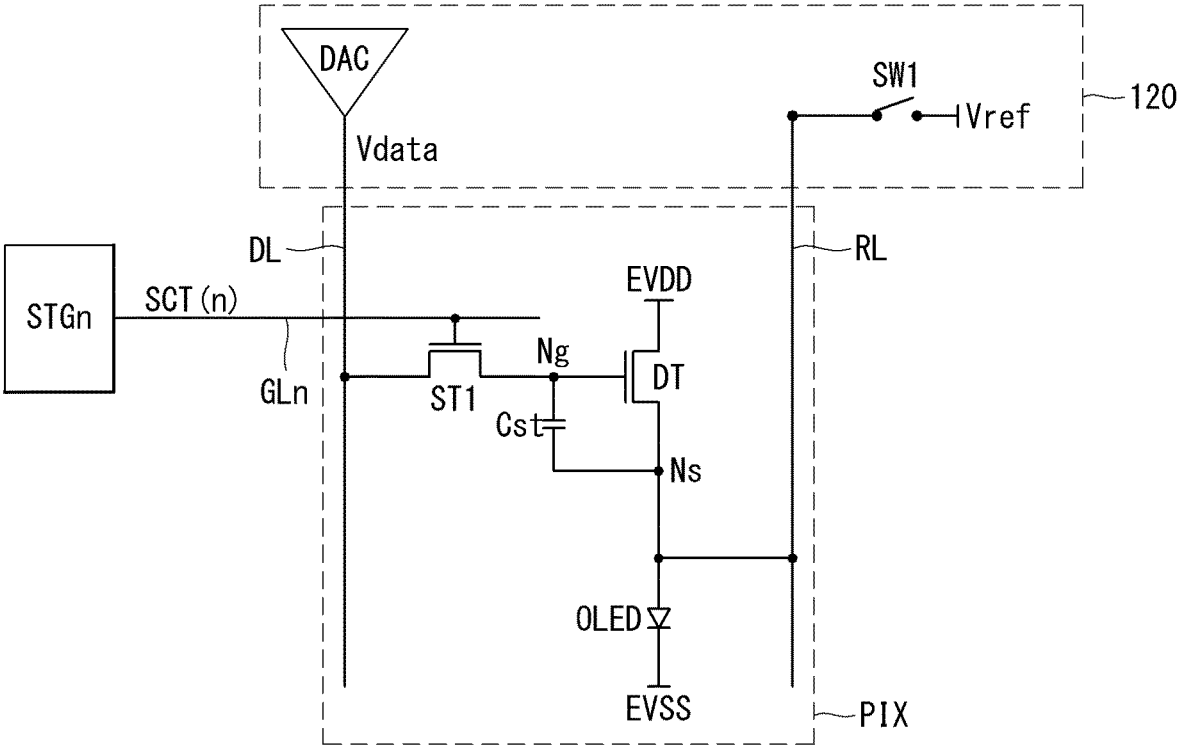
FIG. 4 is a view illustrating one pixel and a data driving circuit connected to the stage of FIG. 3.
Figure 6:
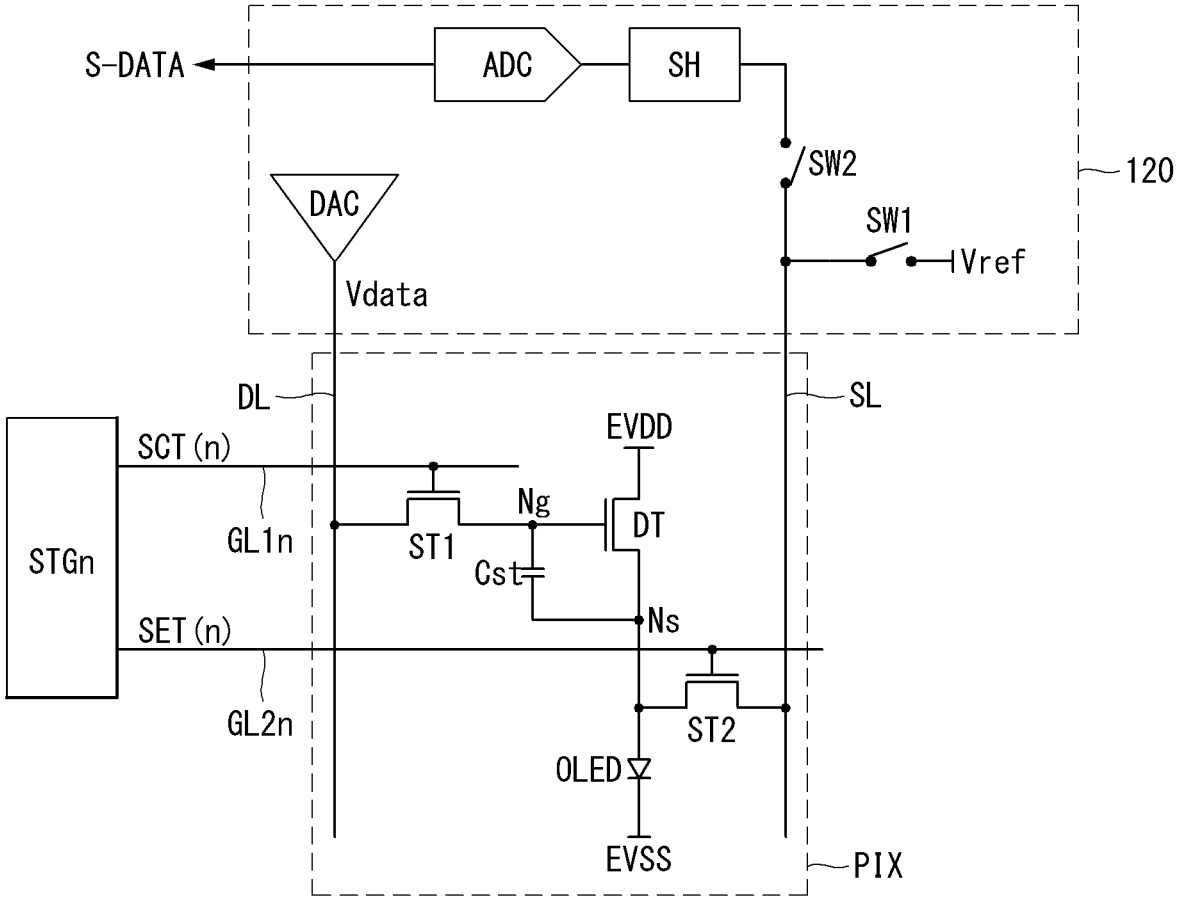
FIG. 6 is a view illustrating one pixel and a data driving circuit connected to the stages of FIG. 5.

Meanwhile, although not shown, the stages STGn to STGn+3 132 may further generate a sensing control signal and then supply the sensing control signal to the gate lines. The sensing control signal is a gate signal for switching a current flow between the pixels and the sensing lines. The sensing control signal may be omitted in the pixel structure as illustrated in FIG. 4, but it is useful in the pixel structure for external compensation as illustrated in FIG. 6.

In order to generate the scan control signals SCT(n) to SCT(n+3), the carry signals CRY(n) to CRY(n+3), and the sensing control signal, the stages STGn to STGn+3 132 may receive a global start signal VSP, shift clocks CLKs, a global reset signal (not shown), and the like, from an external timing controller (not shown).

The global start signal VSP, the shift clocks CLKs, and the global reset signal are signals commonly supplied to the stages STGn to STGn+3 132. The global start signal VSP may further be carried to a start terminal of the upper dummy stage and the global reset signal may further be carried to a reset terminal of the lower dummy stage.

Each of the stages STGn to STGn+3 132 activates an operation of a node Q according to a front stage carry signal applied to the start terminal at every frame. The front stage carry signal is a carry signal applied from one of the front stages. Here, some of the stages STGn to STGn+3 132 may receive a carry signal from the upper dummy stage. The upper dummy stage may be operated according to the global start signal VSP and supply the carry signal to some of the upper stages.

Each of the stages STGn to STGn+3 132 deactivates the operation of the node Q according to a rear stage carry signal applied to the reset terminal at every frame. The rear stage carry signal is a carry signal applied from one of the rear stages. Here, some of the stages STGn to STGn+3 132 may receive a carry signal from the lower dummy stage. The lower dummy stage may be operated according to the global reset signal and supply the carry signal to some of the lower stages.

A plurality of shift clocks CLKs may be supplied to each of the stages STGn to STGn+3 132. The shift clocks CLKs may include scan shift clocks which are sequentially shifted in phase and carry shift clocks which are sequentially shifted in phase, and may further include sensing shift clocks which are sequentially shifted in phase. The scan shift clocks are clock signals for generating the scan control signals SCT(n) to SCT(n+3) and the carry shift clocks are clock signals for generating the carry signals CRY(n) to CRY(n+3). The sensing shift clocks are clock signals for generating a sensing signal. The scan shift clocks swing between the gate high voltage and the gate low voltage to synchronize with the scan control signals SCT(n) to SCT(n+3). The carry shift clocks swing between the gate high voltage and the gate low voltage in synchronization with the carry signals CRY(n) to CRY(n+3). The sensing shift clocks swing between the gate high voltage and the gate low voltage to synchronize with the sensing signal.

These shift clocks CLKs may be driven in an overlapping manner to secure a sufficient charge time when driven at a high speed. The clocks of neighboring phases may overlap each other by a predetermined gate high interval (gate on interval) according to the overlap driving.

In order to simplify the connection configuration of the stages STGn to STGn+3 132 and reduce the bezel area BZ, some of the clock lines for supplying the shift clocks CLKs may be eliminated. This will be described in detail in FIGS. 7 to 22.

Each of the stages STGn to STGn+3 132 may receive a power supply voltage PS from an external power supply unit (not shown). The power supply voltage PS includes a high potential power supply voltage and a low potential power supply voltage. The high potential power supply voltage may be set to a gate high voltage, for example, 12V. The low potential supply voltage may be set to a plurality of gate low voltages, e.g., −6V and −12V, to suppress leakage currents of transistors that belong to each of the stages STGn to STGn+3 132. In this case, scan shift clocks may be swung between −6V and 12V and carry shift clocks may be swung between −12V and 12V. In other words, a swing width of the carry shift clocks may be larger than a swing width of the scan shift clocks. A swing width of the carry signals CRY(n) to CRY(n+3) may be larger than the swing width of a scan control signals SCT(n) to SCT(n+3). This is effective in suppressing deterioration of a pull-down transistor in which a gate electrode is connected to a node Qb in each stage.

Figure 3:
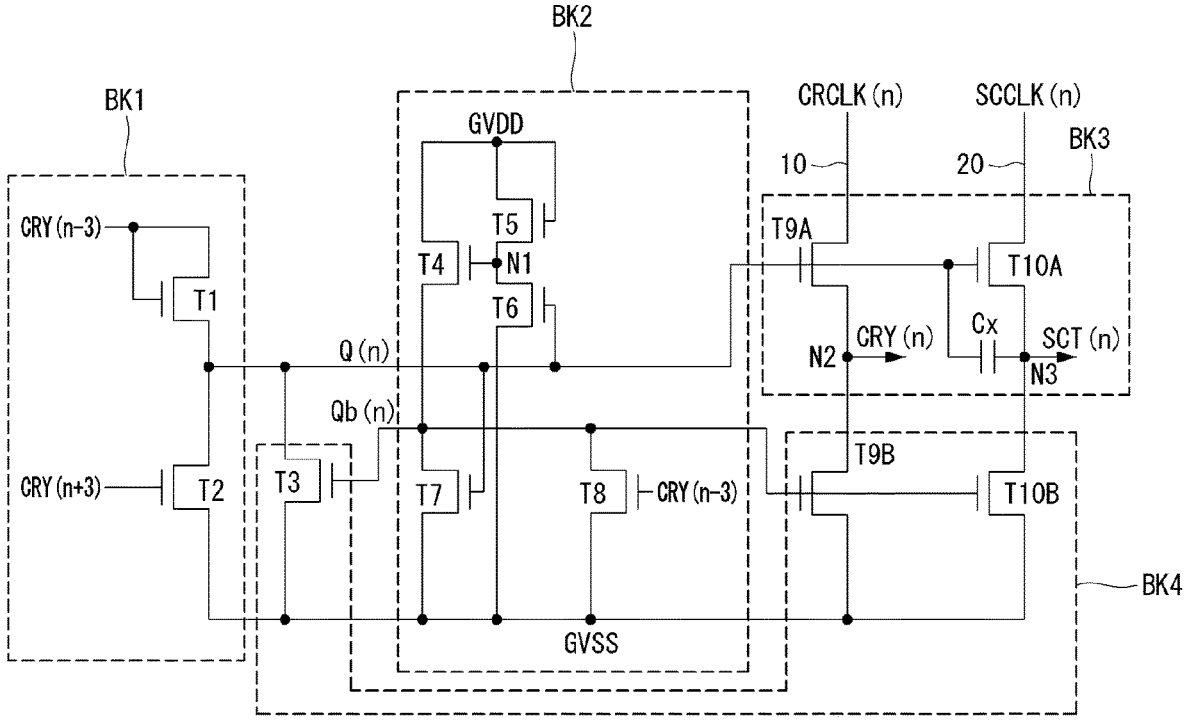
FIG. 3 is a circuit diagram illustrating a stage according to an embodiment of the present disclosure.

FIG. 3 is a circuit diagram illustrating a stage according to an embodiment of the present disclosure. FIG. 4 is a view illustrating a pixel connected to the stage of FIG. 3 and a data driving circuit.

FIG. 3 illustrates the n-th stage STGn 132 outputting an n-th gate signal SCT(n) and an n-th carry signal CRY(n). In FIG. 3, a high potential power supply voltage GVDD has a gate high voltage level from the power supply PS. A low potential power supply voltage GVSS may be substantially equal to the gate low voltage from the power supply PS. Since the stage of FIG. 3 is connected to the pixel as illustrated in FIG. 4, it is unnecessary to output a sensing control signal by receiving the sensing shift clocks.

Referring to FIG. 3, the stage STGn includes an input unit BK1, an inverter unit BK2, an output buffer BK3, and a stabilization unit BK4.

In response to the front stage carry signal CRY(n−3) input through the start terminal, the input unit BK1 activates a potential of the node Q(n) to the high potential power supply voltage GVDD. In response to the rear stage carry signal CRY(n+3) input through the reset terminal, the input unit BK1 deactivates the potential of the node Q(n) to the low potential power supply voltage GVSS.

To this end, the input unit BK1 includes a plurality of transistors T1 and T2. The transistor T1 includes a gate electrode and a drain electrode connected to the start terminal to which the front stage carry signal CRY(n−3) is applied and a source electrode connected to the node Q(n) and applies the front stage carry signal CRY(n−3) to the node Q(n). The transistor T2 includes a gate electrode connected to the reset terminal to which the rear stage carry signal CRY(n+3) is applied, a drain electrode connected to the node Q(n), and a source electrode connected to the node GVSS. The transistor T2 connects the node Q(n) with the low potential power supply voltage GVSS, while the rear stage carry signal CRY(n+3) is being input, to inactivate the node Q(n).

The inverter unit BK2 charges and discharges node Qb(n) reversely of the node Q(n). The inverter unit BK2 may activate the node Qb(n) by applying the high potential power supply voltage GVDD to the node Qb(n) according to the potential of the node N1. The potential of the node N1 is controlled in the reverse manner according to the node Q(n). While the node Q(n) is activated, the node N1 is deactivated to the low potential power supply voltage GVSS, and while the node Q(n) is deactivated, the node N1 is activated to the high potential power supply voltage GVDD. In other words, the potential of the node Qb(n) is activated to the high potential power supply voltage GVDD, while the low potential power supply voltage GVSS is applied to the node Q(n).

To this end, the inverter unit BK2 includes a plurality of transistors T4, T5 and T6. The transistor T4 includes a gate electrode connected to the node N1, a drain electrode to which the high potential power supply voltage GVDD is applied, and a source electrode connected to the node Qb(n). The transistor T5 includes a gate electrode and a drain electrode to which the high potential power supply voltage GVDD is applied and a source electrode connected to the node N1. The transistor T6 includes a gate electrode connected to the node Q(n), a drain electrode connected to the node N1, and a source electrode to which the low potential power supply voltage GVSS is applied.

The inverter unit BK2 deactivates the potential of the node Qb(n) to the low potential power supply voltage GVSS while the node Q(n) is activated. The inverter unit BK2 may further deactivate the potential of the node Qb(n) to the low potential power supply voltage GVSS according to the front stage carry signal CRY(n−3) in order to improve reliability of the operation.

To this end, the inverter unit BK2 further includes a plurality of transistors T7 and T8. The transistor T7 includes a gate electrode connected to the node Q(n), a drain electrode connected to the node Qb(n), and a source electrode to which the low potential supply voltage GVSS is applied. The transistor T8 includes a gate electrode to which the front stage carry signal CRY(n−3) is applied, a drain electrode connected to the node Qb(n), and a source electrode to which the low potential power supply voltage GVSS is applied.

The output buffer BK3 outputs a scan shift clock SCCLK (n) as the scan control signal SCT(n) at the output node N3 when the potential of the node Q(n) rises to a boosting level, and outputs the carry shift clock CRCLK(n) as the carry signal CRY(n) at the output node N2.

To this end, the output buffer BK3 includes first and second pull-up transistors T9A and T10A and a capacitor Cx. The first pull-up transistor T9A includes a gate electrode connected to the node Q(n), a drain electrode connected to any one of the carry clock lines 10, and a source electrode connected to the output node N2. The second pull-up transistor T10A includes a gate electrode connected to the node Q(n), a drain electrode connected to any one of the scan clock lines 20, and a source electrode connected to the output node N3. The capacitor Cx is connected between the node Q(n) and the output node N3.

The stabilization unit BK4 applies the low potential power supply voltage GVSS to the node Q(n) and the output nodes N2 and N3 during activation of the node Qb(n) to stabilize the node Q(n) and the output nodes N2 and N3.

To this end, the stabilization unit BK4 includes a transistor T3 and first and second pull-down transistors T9B and T10B. The transistor T3 includes a gate electrode connected to the node Qb(n), a drain electrode connected to the node Q(n), and a source electrode to which the low potential power supply voltage GVSS is applied. The first pull-down transistor T9B includes a gate electrode connected to the node Qb(n), a drain electrode connected to the output node N2, and a source electrode to which the low potential power supply voltage GVSS is applied. The second pull-down transistor T10B includes a gate electrode connected to the node Qb(n), a drain electrode connected to the output node N3, and a source electrode to which the low potential power supply voltage GVSS is applied.

The scan control signal SCT(n) output from the stage STGn 132 is carried to the pixel PIX through the gate line GLn as illustrated in FIG. 4. The sensing operation for external compensation is not performed on the pixel PIX of FIG. 4. The sensing for external compensation is a technique for sensing electrical characteristics of the pixels, that is, a change in a threshold voltage and mobility of the driving TFT, a change in an operating point voltage of the OLED, and the like, and correcting image data on the basis of the sensing result.

The pixel PIX in FIG. 4 operates in a basic mode for image display. In the basic mode, the pixel PIX sets a gate-source voltage Vgs of the driving TFT DT to a driving current for display gradation implementation during a programming period in which the scan control signal SCT(n) is activated, and subsequently allows the OLED to emit light according to the driving current during an emission period in which the scan control signal SCT(n) is inactivated.

To this end, the pixel PIX may include the OLED, the driving TFT DT, a switching TFT ST1, and a storage capacitor Cst. During the programming period, the switching TFT ST1 is turned on to supply the data voltage Vdata on the data line DL to the gate electrode Ng of the driving TFT DT. During the programming period, the switch SW1 of the source driver IC 120 is also turned on to supply the reference voltage Vref to the source electrode Ns of the driving TFT DT. Therefore, during the programming period, the gate-source voltage Vgs of the driving TFT DT is determined as Vdata-Vref. During the emission period, the switching TFT ST1 and the switch SW1 are turned off. During the emission period, the gate-source voltage Vgs of the driving TFT DT is maintained by the storage capacitor Cst. During the emission period, a driving current proportional to the square of Vdata-Vref flows through the driving TFT DT, and the OLED emits light by the driving current. In FIG. 4, the DAC indicates a digital-to-analog converter for converting the image data RGB to the data voltage Vdata, and RL is a power supply line for supplying the reference voltage Vref to the pixel PIX.

During the programming period, the switching TFT ST1 is turned on according to the scan control signal SCT(n). If a waveform of the scan control signal SCT(n) is distorted due to distortion of the scan shift clock SCCLK(n), the switching TFT ST1 may not be turn on sufficiently for a predetermined period. Since a charge time of the data voltage Vdata is determined according to the turn-on period of the switching TFT ST1, if the turn-on period of the switching TFT ST1 is insufficient, the gate-source voltage Vgs of the driving TFT DT may not reach a desired value due to insufficient charge. In this case, the driving current flowing through the driving TFT DT and the emission amount of the OLED are also reduced, causing a luminance variation and degrading image quality. Therefore, in order to improve image quality, it is helpful to minimize distortion of the scan shift clock SCCLK(n).

Figure 5:
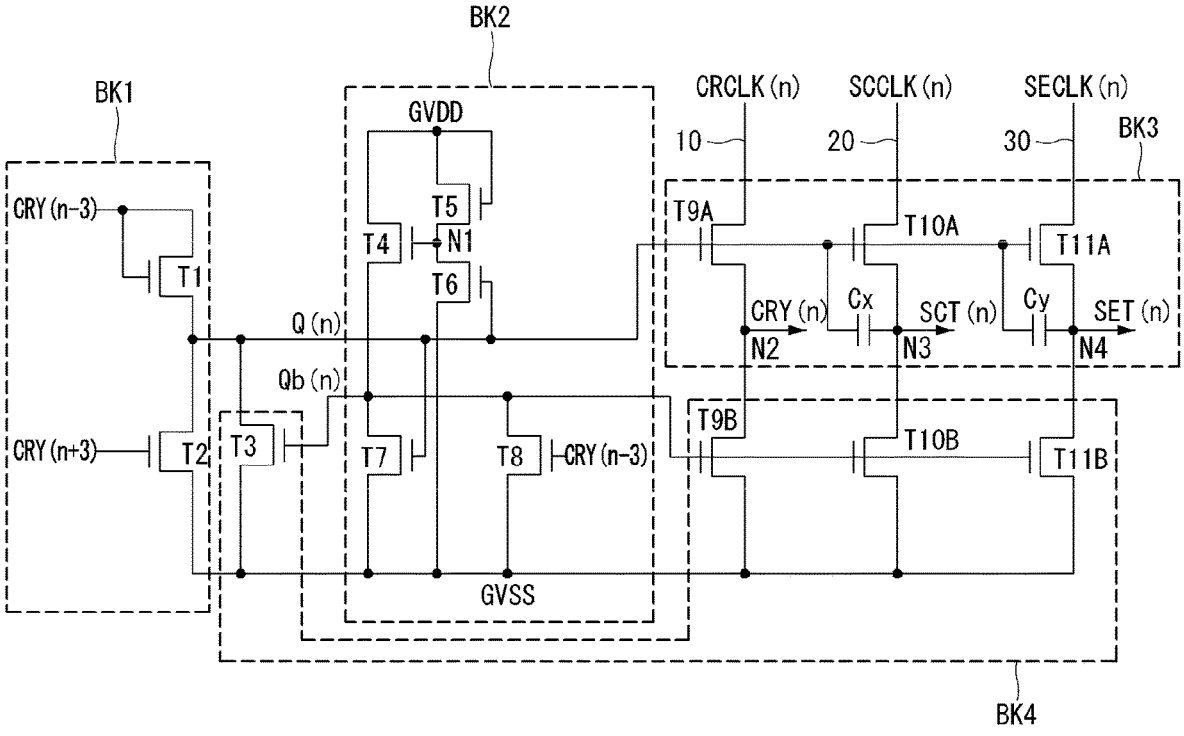
FIG. 5 is a circuit diagram illustrating a stage according to another embodiment of the present disclosure.

FIG. 5 is a circuit diagram illustrating a stage STGn 132 according to another embodiment of the present disclosure. FIG. 6 is a view illustrating one pixel connected to a stage STGn 132 of FIG. 5 and a data driving circuit.

Since the stage STGn 132 of FIG. 5 is connected to the pixel as illustrated in FIG. 6, the sensing shift clock SECLK (n) must be applied to output the sensing control signal SET(n). Therefore, the stage STGn 132 of FIG. 5 is substantially the same as the input unit BK1 and the inverter unit BK2 in comparison with FIG. 3, and differs in the configuration of the output buffer BK3 and the stabilization unit BK4.

Compared with FIG. 3, the output buffer BK3 of FIG. 5 further includes a component for outputting a sensing control signal SET(n). To this end, the output buffer BK3 of FIG. 5 further includes a third pull-up transistor T11A. The third pull-up transistor T11A includes a gate electrode connected to the node Q(n), a drain electrode connected to any one of the sensing clock lines 30, and a source electrode connected to the output node N4. The third pull-up transistor T11A outputs the sensing shift clock SECLK(n) as the sensing control signal SET(n) at an output node N4 when the potential of the node Q(n) rises to boosting level.

Compared with FIG. 3, the stabilization unit BK4 of FIG. 5 further includes a third pull-down transistor T11B. The third pull-down transistor T11B includes a gate electrode connected to the node Qb(n), a drain electrode connected to the output node N4, and a source electrode to which the low potential power supply voltage GVSS is applied.

The scan control signal SCT(n) output from the stage STGn is carried to the pixel PIX through the gate line GLn as illustrated in FIG. 6. The sensing control signal SET(n) output from the stage STGn is carried to the pixel PIX through the gate line GL2*n* as illustrated in FIG. 6. A sensing operation for external compensation is performed on the pixel PIX in FIG. 6. Sensing for external compensation is a technology of sensing electrical characteristics of a pixel and correcting image data based on the sensing result.

Compared with FIG. 4, the pixel PIX in FIG. 6 further includes a second switching TFT ST2, and the source drive IC 120 in FIG. 6 further includes a sensing circuit. The second switching TFT ST2 is turned on according to the sensing control signal SET(n) to connect the source node Ns of the driving TFT DT to the sensing line SL. The sensing circuit includes a sample and hold section SH for sampling a voltage across the source node Ns of the driving TFT DT, a switch SW2 for connecting the sensing line SL and the sample and hold section SH, and an analog-to-digital converter ADC that converts the voltage sampled at the sample and hold section SH into digital data S-DATA. The sensing circuit is activated only in a sensing mode for sensing electrical characteristics of the pixel PIX and does not operate in a basic mode for displaying an image.

The basic mode for the pixel PIX in FIG. 6 includes a programming period and an emission period.

During the programming period, the first switch ST1 is turned on to supply the data voltage Vdata on the data line DL to the gate electrode Ng of the driving TFT DT. During the programming period, the second switching TFT ST2 and the switch SW1 of the source drive IC 120 are also turned on to supply the reference voltage Vref to the source electrode Ns of the driving TFT DT. Therefore, the gate-source voltage Vgs of the driving TFT DT is determined as Vdata-Vref during the programming period. During the emission period, the first and second switching TFTs ST1 and ST2 and the switch SW1 are turned off. During the emission period, the gate-source voltage Vgs of the driving TFT DT is maintained by the storage capacitor Cst. During the emission period, a driving current proportional to the square of Vdata-Vref flows through the driving TFT DT, and the OLED is emitted by this driving current.

The sensing mode for the pixel PIX and the sensing circuit of FIG. 6 includes a programming period and a sensing period. In the sensing mode, the OLED does not emit light.

An operation of the programming period is the same as that of the basic mode. During the programming period, the switch SW1 is turned on and the switch SW2 is turned off.

During the sensing period, the first switching TFT ST1 and the switch SW1 are turned off, and the second switching TFT ST2 and the switch SW2 are turned on. The voltage of the source electrode Ns of the driving TFT DT is changed by the current flowing in the driving TFT DT during the sensing period. The degree to which the voltage of the source electrode Ns of the driving TFT DT is varied depending on electrical characteristics (e.g., threshold voltage, mobility) of the driving TFT DT and electrical characteristics (e.g., operating point voltage) of the OLED. Therefore, by sensing the voltage of the source electrode Ns of the driving TFT DT by operating the sensing circuit during the sensing period, the electrical characteristics of the pixel PIX may be known. Also, by correcting the image data based on the pixel PIX sensing result, luminance deviation due to the electrical characteristic deviation of the pixel PIX may be compensated.

Meanwhile, in the basic mode, during the programming period, the switching TFT ST1 is turned on according to the scan control signal SCT(n). If the waveform of the scan control signal SCT(n) is distorted due to distortion of the scan shift clock SCCLK(n), the switching TFT ST1 may not be turned on sufficiently for a predetermined period. Since a charge time of the data voltage Vdata is determined according to a turn-on period of the switching TFT ST1, if the turn-on period of the switching TFT ST1 is not sufficient, the gate-source voltage Vgs of the driving TFT DT may not reach a desired value due to the insufficient charging. In this case, the driving current flowing in the driving TFT DT and the emission amount of OLED are reduced, causing a luminance variation and degrading image quality. Therefore, in order to improve image quality, it is helpful to minimize distortion of the scan shift clock SCCLK(n).

Figure 7:
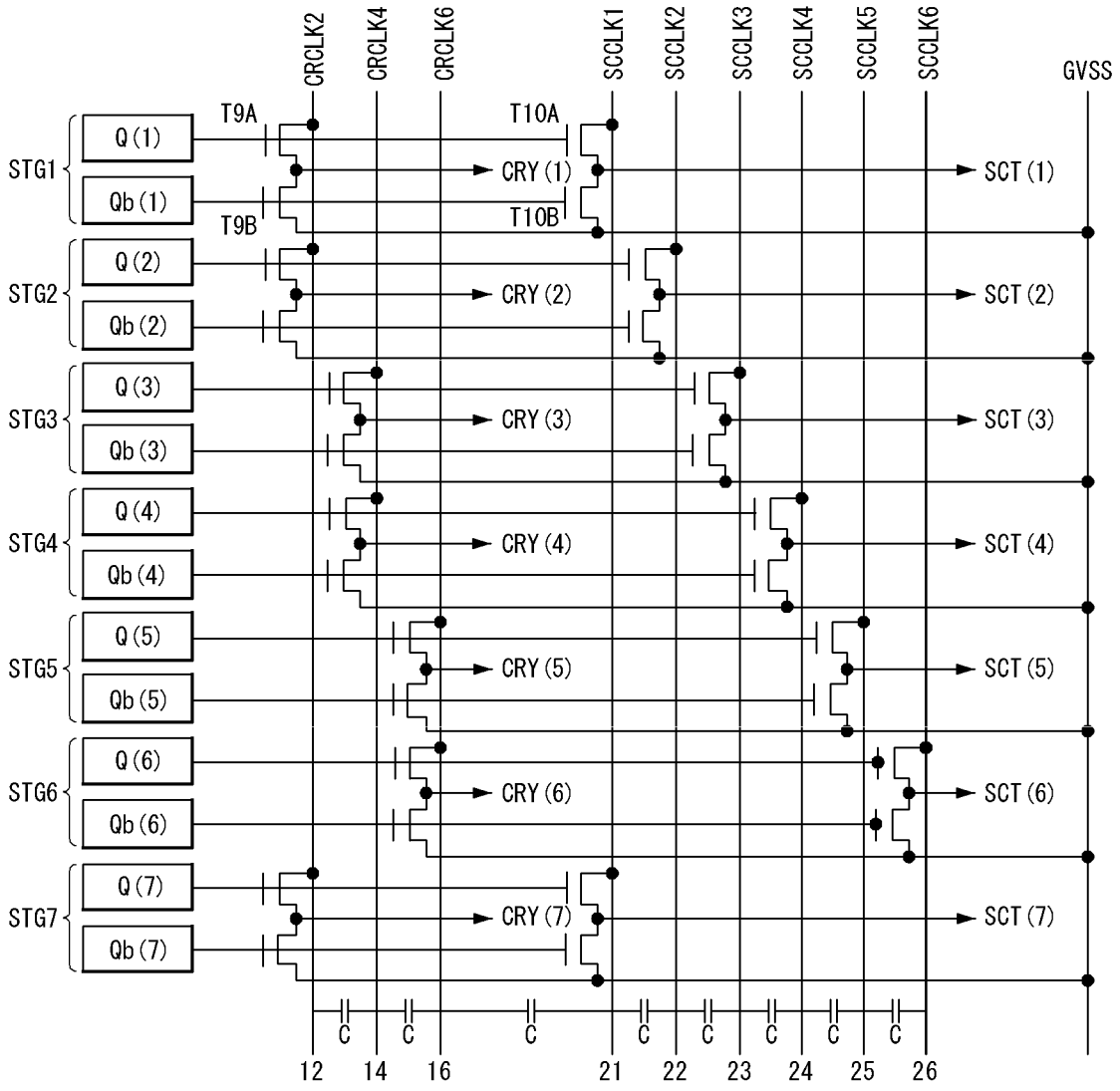
FIG. 7 is a view illustrating an example of arrangement of clock lines positioned on the gate-in-panel substrate connected to the stages illustrated in FIG. 3.
Figure 8:
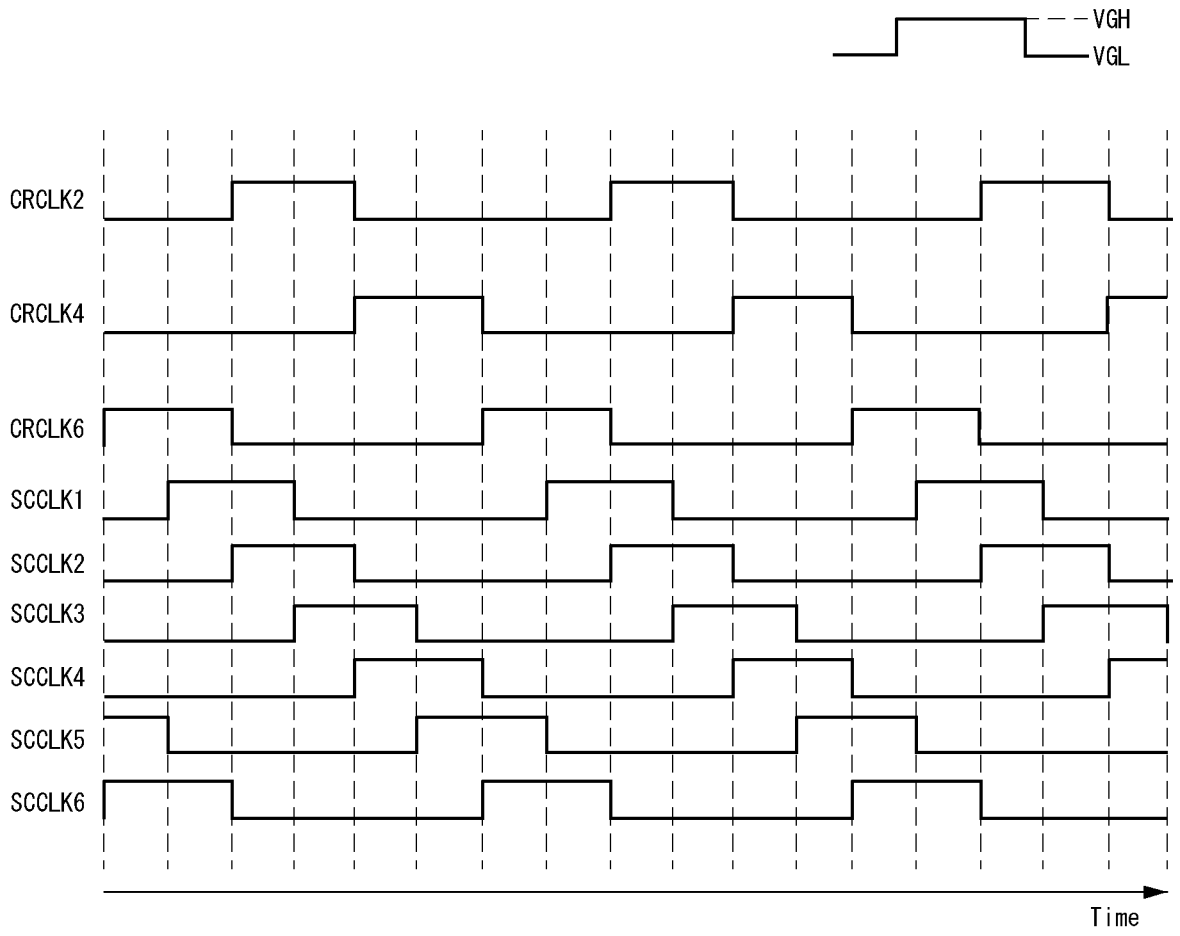
FIG. 8 is a view illustrating waveforms of shift clocks applied to clock lines of FIG. 7.

FIG. 7 is a view illustrating portions of the circuits in STGn 132 as an example of arrangement of clock lines positioned on the gate-in-panel substrate connected to the stages STGn 132 illustrated in FIG. 3. FIG. 8 is a view illustrating waveforms of shift clocks applied to the clock lines of FIG. 7. Portions of BK3 and BK4 are shown corresponding to similar circuits in FIGS. 3 and 5, and other figures and bear the same reference numbers and labels.

Referring to FIGS. 7 and 8, the gate shift register may include a plurality of shared carry clock lines 12, 14, and 16 positioned on the gate-in-panel substrate and supplying carry shift clocks CRCLK2, CRCLK4, and CRCLK6 having different phases to the stages STG1 to STG7 and a plurality of scan clock lines 21 to 26 positioned on the gate-in-panel substrate and supplying scan shift clocks SCCLK1 to SCCLK6 having different phases to the stages STG1 to STG7.

The number of shared carry clock lines 12, 14, and 16 may be set to half of the number of scan clock lines 21 to 26 in order to reduce the number of clock lines connected to the stages STG1 to STG7. To this end, the stage pairs STG1/STG2, STG3/STG4, STG5/STG6, etc., including neighboring odd-numbered numbered stages STG1, STG3, and STG5, etc., and neighboring even-numbered stages STG2, STG4, and STG6, etc., may share one carry shift clock CRCLK2, CRCLK4, or CRCLK6, respectively.

Here, the odd-numbered scan shift clocks SCCLK1, SCCLK3 and SCCLK5 supplied to the odd-numbered stage STG1, STG3, and STG5 and the even-numbered scan shift clocks SCCLK2 and SCCLK4, and SCCLK6 supplied to the even-numbered stages STG2, STG4, and STG6 partially overlap in an ON period (VGH period). The shared carry shift clocks CRCLK2, CRCLK4, and CRCLK6 may overlap in any one of the odd-numbered scan shift clocks SCCLK1, SCCLK3, and SCCLK5 and the even-numbered scan shift clocks SCCLK2, SCCLK4, and SCCLK6 in the ON period (VGH period). Therefore, although the number of carry clock lines is reduced, the gate shift register may operate normally. Meanwhile, in FIG. 8, carry shift clocks CRCLK2, CRCLK4, and CRCLK6) fully overlap for the entire circuit of basic display operation for the even-numbered scan shift clocks SCCLK2, SCCLK4, and SCCLK6), respectively, but it may also be designed such that the carry shift clocks CRCLK2, CRCLK4, and CRCLK6 to fully overlap the odd-numbered scan shift clocks SCCLK1, SCCLK3, and SCCLK5, respectively. Others of the clock signals partially overlap in timing and voltage levels.

The shared carry clock lines 12, 14 and 16 connected to the stages STG1 to STG7 may be disposed adjacent to each other and the scan clock lines 21 to 26 connected to the stages STG1 to STG7 may be disposed adjacent to each other. In order to realize a narrow bezel, the spacing between the clock lines 12, 14, 16, and 21 to 26 may be designed to be narrow, and in this case, a coupling effect of parasitic capacitance C present between the clock lines 12, 14, 16, and 21 to 26 may be significant. In case where the spacing between two neighboring clock lines is narrow, if signals having the same phase and voltage levels are applied to the clock lines, rising and falling timings of the signals are the same, and thus, signal distortion due to the coupling effect may not occur since the coupling effect of parasitic capacitance C between adjacent lines occurs when conductive lines at different voltage levels are closely adjacent to each other.

However, when signals having different phases are applied to the clock lines, the rising and falling timings of the signals are different, causing signal distortion due to the parasitic capacitance coupling effect. As described above with reference to FIGS. 4 and 6, distortion of the scan-shift clocks SCCLK1 to SCCLK6 causes distortion of the scan control signals SCT(1) to SCT(7), which may directly affect image quality.

Figure 9:
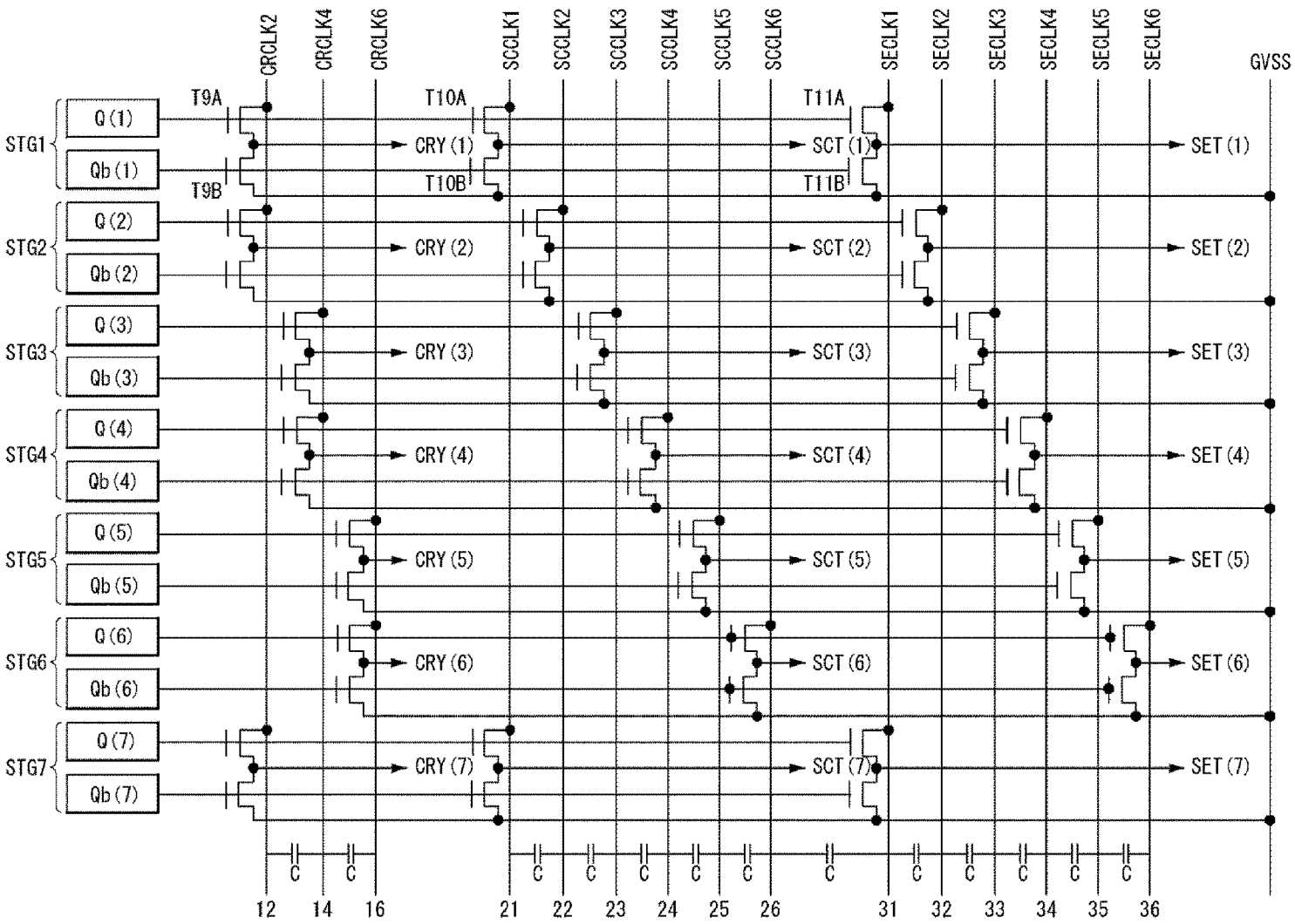
FIG. 9 is a view illustrating an example of arrangement of clock lines positioned on the gate-in-panel substrate connected to the stages illustrated in FIG. 5.
Figure 10:
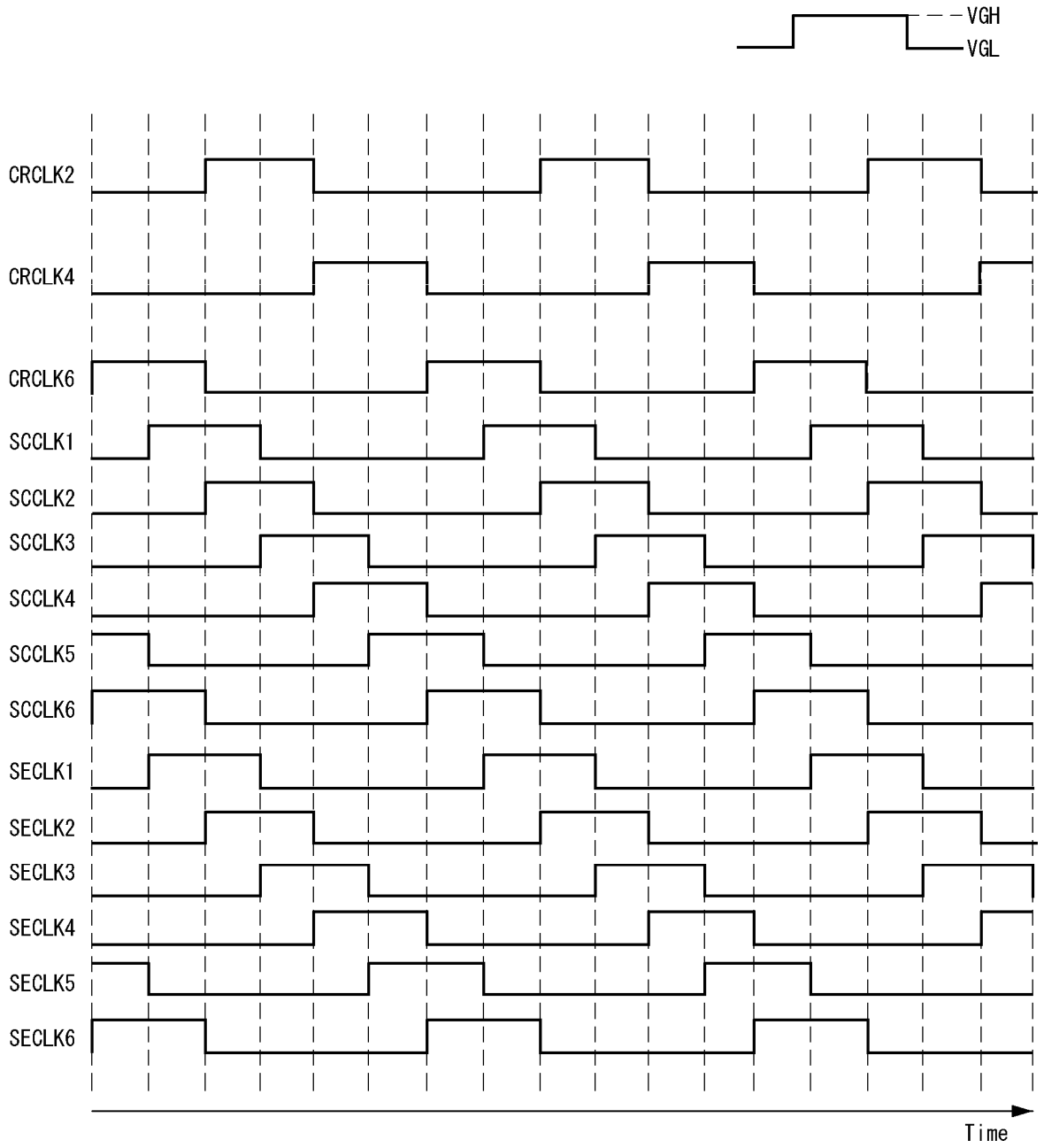
FIG. 10 is a view illustrating waveforms of shift clocks applied to the clock lines of FIG. 9.

FIG. 9 is a view illustrating an example of arrangement of clock lines positioned on the gate-in-panel substrate connected to the stages illustrated in FIG. 5. FIG. 10 is a view illustrating waveforms of shift clocks applied to the clock lines of FIG. 9.

Referring to FIGS. 9 and 10, the gate shift register may include a plurality of shared carry clock lines 12, 14, and 16 supplying carry shift clocks CRCLK2, CRCLK4, and CRCLK6 having different phases to the stages STG1 to STG7, a plurality of scan clock lines 21 to 26 supplying scan shift clocks SCCLK1 to SCCLK6 having different phases to the stages STG1 to STG7, and a plurality of sensing clock lines 31 to 36 positioned on the gate-in-panel substrate and supplying sensing shift clocks SECLK1 to SECLK6 having different phases to the stages STG1 to STG7.

In order to reduce the number of clock lines connected to the stages STG1 to STG7, positioned on the gate-in-panel substrate the number of shared carry clock lines 12, 14, and 16 may be set to half of the number of scan clock lines 21 to 26. To this end, the stage pairs STG1/STG2, STG3/STG4, STG5/STG6, etc., including neighboring odd-numbered stages STG1, STG3, and STG5, etc., and neighboring even-numbered stages STG2, STG4, and STG6, etc., may share the carry shift clocks CRCLK2, CRCLK4, and CRCLK6, respectively.

Another way to reduce the overall parasitic capacitive coupling effect is to have few conductive lines, thus by using a single carry clock line 12, CRCLK2 to provide the clock for two stages. Thus, as shown in FIG. 7, the carry clock 12 is coupled to stages 1 and 2, reducing by half the number of carry clock lines that need to be provided on the PCB 140. By having fewer clock lines, the capacitive coupling overall is reduced.

Here, the odd-numbered scan shift clocks SCCLK1, SCCLK3, and SCCLK5 supplied to the odd-numbered stage STG1, STG3, and STG5 and the even-numbered scan shift clocks SCCLK2, SCCLK4, and SCCLK6 supplied to the even-numbered stages STG2, STG4, and STG6 partially overlap in the ON period (VGH period). The shared carry shift clocks CRCLK2, CRCLK4, and CRCLK6 may partially overlap in any one of the odd-numbered scan shift clocks SCCLK1, SCCLK3, and SCCLK5 and may overlap with the even-numbered scan shift clocks SCCLK2, SCCLK4, and SCCLK6 in the ON period (VGH period). In some embodiments, the clocks partially overlap and in other embodiments, they fully overlap. Therefore, although the number of carry clock lines is reduced, the gate shift register may operate normally. Meanwhile, in FIG. 10, the carry shift clocks CRCLK2, CRCLK4, and CRCLK6 overlap the even-numbered scan shift clocks SCCLK2, SCCLK4, and SCCLK6, respectively, but the carry shift clocks CRCLK2, CRCLK4, and CRCLK6 may be designed to overlap the odd-numbered scan shift clocks SCCLK1, SCCLK3, and SCCLK5, respectively.

The number of the sensing clock lines 31 to 36 may be set to be equal to the number of the scan clock lines 21 to 26, and the sensing shift clocks SECLK1 to SECLK6 may be set to be in phase with the scan shift clocks SCCLK1 to SCCLK6. Therefore, the shared carry shift clocks CRCLK2, CRCLK4, and CRCLK6 may overlap either the odd-numbered sensing shift clocks SECLK1, SECLK3, and SECLK5 or the even-numbered sensing shift clocks SECLK2, SECLK4, and SECLK6 in the ON period (VGH period).

The shared carry clock lines 12, 14 and 16 connected to the stages STG1 to STG7 may be disposed adjacent to each other, the scan clock lines 21 to 26 connected to the stages STG1 to STG7 may be disposed adjacent to each other, and the sensing clock lines 31 to 36 connected to the stages STG1 to STG7 may be disposed adjacent to each other. In order to realize a narrow bezel, the spacing between the clock lines 12, 14, 16, 21 to 26, and 31 to 36 positioned on the gate-in-panel substrate may be designed to be narrow, and in this case, a coupling effect of parasitic capacitance C present between the clock lines 12, 14, 16, and 21 to 26 may be significant. In case where the spacing between two neighboring clock lines is narrow, if signals having the same phase are applied to the clock lines, rising and falling timings of the signals are the same, and thus, signal distortion due to the coupling effect may not occur. However, when signals having different signals are applied to the clock lines, the rising and falling timings of the signals are different, causing signal distortion due to the coupling effect. As described above with reference to FIGS. 4 and 6, distortion of the scan-shift clocks SCCLK1 to SCCLK6 causes distortion of the scan control signals SCT(1) to SCT(7), which may directly affect image quality.

Figure 11:
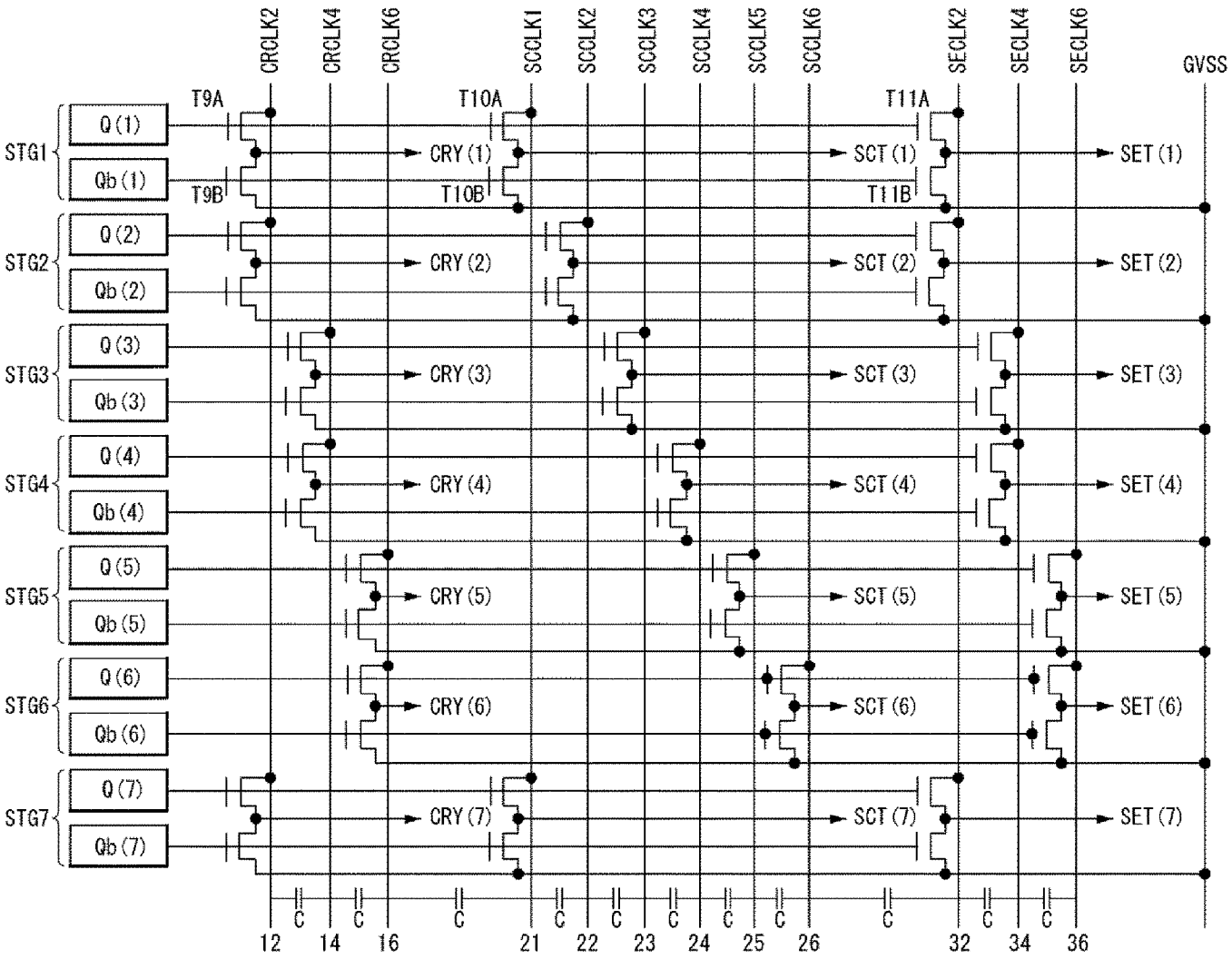
FIG. 11 is a view illustrating another arrangement example of clock lines positioned on the gate-in-panel substrate connected to the stages illustrated in FIG. 5.
Figure 12:
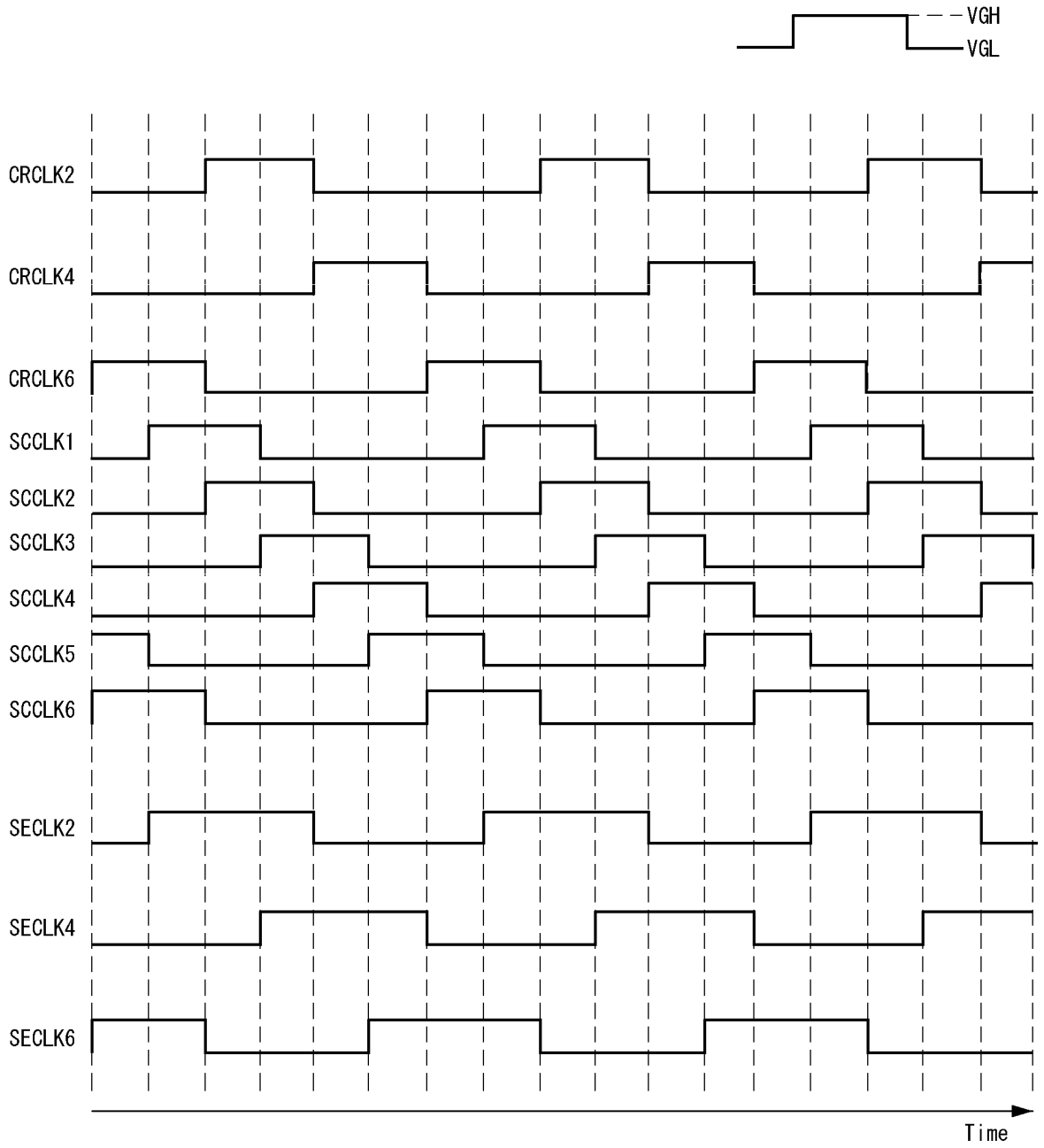
FIG. 12 is a view illustrating waveforms of shift clocks applied to the clock lines of FIG. 11.

FIG. 11 is a view illustrating another arrangement example of clock lines positioned on the gate-in-panel substrate connected to the stages as illustrated in FIG. 5. FIG. 12 is a view illustrating waveforms of shift clocks applied to the clock lines of FIG. 11.

Referring to FIGS. 11 and 12, the gate shift register may include a plurality of scan clock lines 21 to 26 supplying scan shift clocks SCCLK1 to SCCLK6 having different phases to the stages STG1 to STG7 and a plurality of shared sensing clock lines 32, 34, 36 supplying sensing shift clocks SECLK2, SECLK4 and SECLK6 having different phases to the stages STG1 to STG7.

In order to reduce the number of clock lines connected to the stages STG1 to STG7, the number of shared carry clock lines 12, 14 and 16 may be set to half of the number of scan clock lines 21 to 26 and the number of the shared sensing clock lines 32, 34, 36 may also be set to half of the number of the scan clock lines 21 to 26. To this end, stage pairs STG1/STG2, STG3/STG4, STG5/STG6, etc., including neighboring odd-numbered stages STG1, STG3, and STG5 and neighboring even-numbered stages STG2, STG4, and STG6 may share the carry shift clocks CRCLK2, CRCLK4, and CRCLK6, respectively, and may further share the sensing shift clocks SECLK2, SECLK4, and SECLK6, respectively.

Here, the odd-numbered scan shift clocks SCCLK1, SCCLK3 and SCCLK5 supplied to the odd-numbered stage STG1, STG3 and STG5 and the even-numbered scan shift clocks SCCLK2, SCCLK4, and SCCLK6 supplied to the even-numbered stages STG2, STG4 and STG6 are partially overlapped in the ON period (VGH period). Also, the shared carry shift clocks CRCLK2, CRCLK4, and CRCLK6 may overlap either the odd-numbered scan shift clocks SCCLK1, SCCLK3 and SCCLK5 or the even-numbered scan shift clocks SCCLK2, SCCLK4, and SCCLK6 in the ON period (VGH period). Also, the shared sensing shift clocks SECLK2, SECLK4, and SECLK6 may overlap either the odd-numbered scan shift clocks SCCLK1, SCCLK3, and SCCLK5 or the even-numbered scan shift clocks SCCLK2, SCCLK4, and SCCLK6 in the ON period (VGH period). Therefore, the gate shift register may operate normally although the number of carry clock lines and the number of sensing clock lines are reduced. Meanwhile, in FIG. 12, the carry shift clocks CRCLK2, CRCLK4, and CRCLK6 and the sensing shift clocks SECLK2, SECLK4, and SECLK6 overlap the even-numbered scan shift clocks SCCLK2, SCCLK4, and SCCLK6, respectively, but the carry shift clocks CRCLK2, CRCLK4 and CRCLK6 and the sensing shift clocks SECLK2, SECLK4, and SECLK6 may be designed to overlap the odd-numbered scan shift clocks SCCLK1, SCCLK3, and SCCLK5, respectively.

The shared carry clock lines 12, 14, and 16 connected to the stages STG1 to STG7 may be arranged adjacent to each other, scan clock lines 21 to 26 connected to the stages STG1 to STG7 may be arranged adjacent to each other, and the sensing clock lines 32, 34, and 36 connected to the stages STG1 to STG7 may be arranged adjacent to each other. In order to realize a narrow bezel, the spacing between the clock lines 12, 14, 16, 21 to 26, 32, 34, and 36 may be designed to be narrow, and in this case, a coupling effect of parasitic capacitance C present between the clock lines 12, 14, 16, 21 to 26, 32, 34, and 36 may be significant. In case where the spacing between two neighboring clock lines is narrow, if signals having the same phase are applied to the clock lines, rising and falling timings of the signals are the same, and thus, signal distortion due to the coupling effect may not occur. However, when signals having different phases are applied to the clock lines, the rising and falling timings of the signals are different, causing signal distortion due to the coupling effect. As described above with reference to FIGS. 4 and 6, distortion of the scan-shift clocks SCCLK1 to SCCLK6 causes distortion of the scan control signals SCT(1) to SCT(7), which may directly affect image quality.

Figure 13:
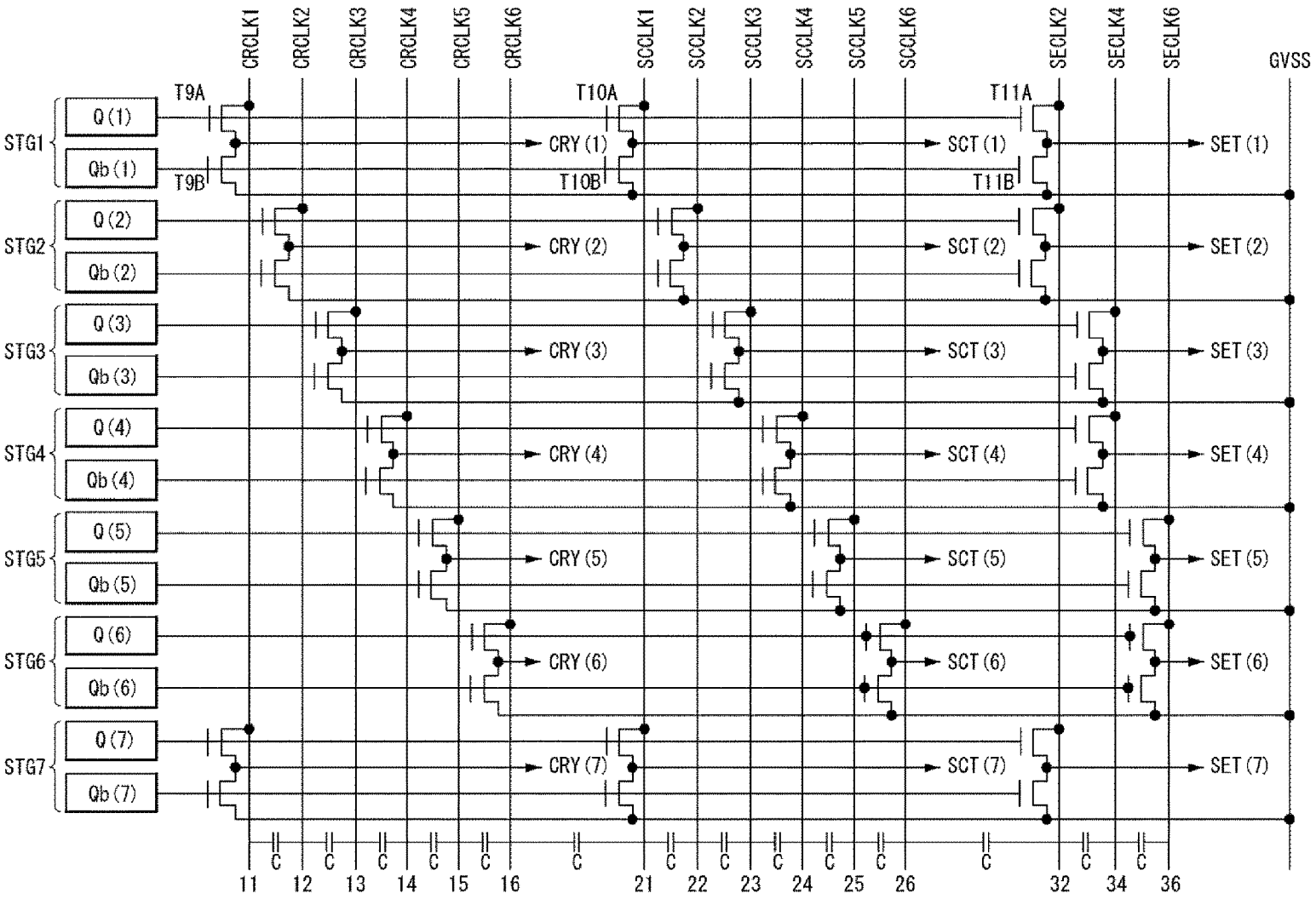
FIG. 13 is a view illustrating another arrangement example of clock lines positioned on the gate-in-panel substrate connected to the stages illustrated in FIG. 5.
Figure 14:
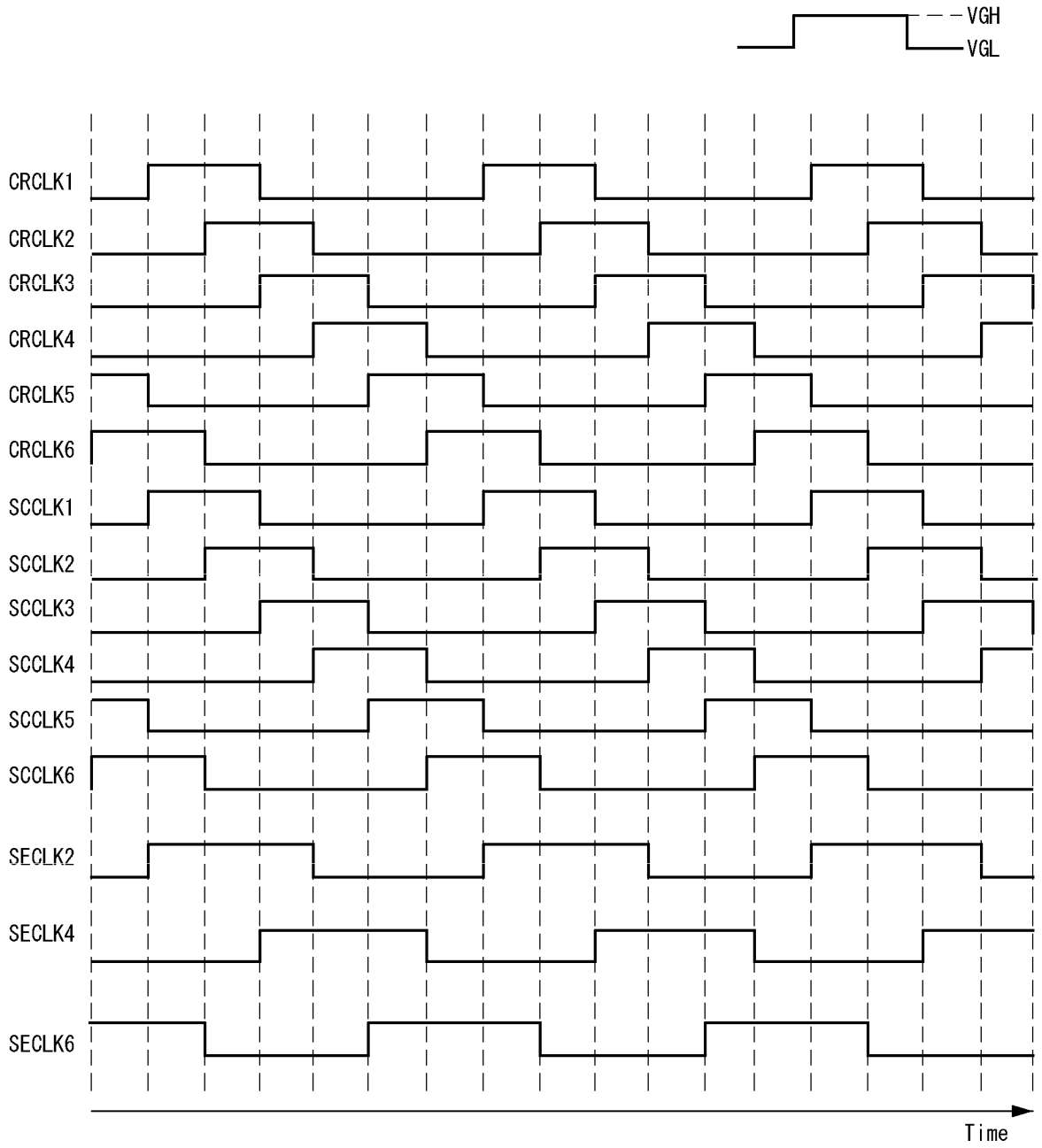
FIG. 14 is a view illustrating waveforms of shift clocks applied to the clock lines of FIG. 13.

FIG. 13 is a view illustrating another example of arrangement of clock lines positioned on the gate-in-panel substrate connected to the stages illustrated in FIG. 5. FIG. 14 is a view illustrating waveforms of shift clocks applied to the clock lines of FIG. 13.

Referring to FIGS. 13 and 14, the gate shift register may include a plurality of shared carry clock lines 11 to 16 supplying carry shift clocks CRCLK1 to CRCLK6 having different phases to the stages STG1 to STG7, a plurality of scan clock lines 21 to 26 supplying scan shift clocks SCCLK1 to SCCLK6 having different phases to the stages STG1 to STG7, and a plurality of shared sensing clock lines 32, 34, and 36 supplying sensing shift clocks SECLK2, SECLK4 and SECLK6 having different phases to the stages STG1 to STG7.

In order to reduce the number of clock lines connected to the stages STG1 to STG7, the number of shared sensing clock lines 32, 34, and 36 may also be set to half of the number of scan clock lines 21 to 26. To this end, the stage pairs STG1/STG2, STG3/STG4, STG5/STG6, etc., including neighboring odd-numbered stages STG1, STG3, and STG5, etc., and neighboring even-numbered stages STG2, STG4, and STG6, etc., may share the sensing shift clocks SECLK2, SECLK4, and SECLK6, respectively.

Here, the odd-numbered scan shift clocks SCCLK1, SCCLK3, and SCCLK5 supplied to the odd-numbered stage STG1, STG3, and STG5 and the even-numbered scan shift clocks SCCLK2, SCCLK4, and SCCLK6 supplied to the even-numbered stages STG2, STG4, and STG6 partially overlap in the ON period (VGH period). The shared sensing shift clocks SECLK2, SECLK4, and SECLK6 may overlap in any one of the odd-numbered scan shift clocks SCCLK1, SCCLK3, and SCCLK5 and the even-numbered scan shift clocks SCCLK2, SCCLK4, and SCCLK6 in the ON period (VGH period). Therefore, although the number of sensing clock lines is reduced, the gate shift register may operate normally. Meanwhile, in FIG. 12, the carry shift clocks CRCLK2, CRCLK4, and CRCLK6 and the sensing shift clocks SECLK2, SECLK4, and SECLK6 overlap the even-numbered scan shift clocks SCCLK2, SCCLK4, and SCCLK6, respectively, but the sensing shift clocks SECLK2, SECLK4, and SECLK6 may be designed to overlap the odd-numbered scan shift clocks SCCLK1, SCCLK3, and SCCLK5, respectively.

The number of the carry clock lines 11 to 16 may be set to be equal to the number of the scan clock lines 21 to 26, and the carry shift clocks CRCLK1 to CRCLK6 may be set to be in phase with the scan shift clocks SCCLK1 to SCCLK6. Therefore, the shared sensing shift clocks SECLK2, SECLK4, and SECLK6 may overlap either the odd-numbered carry shift clocks CRCLK1, CRCLK3, and CRCLK5 or the even-numbered carry shift clocks CRCLK2, CRCLK4, and CRCLK6 in the ON period (VGH period).

The carry clock lines 11 to 16 connected to the stages STG1 to STG7 may be disposed adjacent to each other, the scan clock lines 21 to 26 connected to the stages STG1 to STG7 may be disposed adjacent to each other, and the sensing clock lines 32, 34, and 36 connected to the stages STG1 to STG7 may be disposed adjacent to each other. In order to realize a narrow bezel, the spacing between the clock lines 11 to 16, 21 to 26, 32, 34, and 36 may be designed to be narrow, and in this case, a coupling effect of parasitic capacitance C present between the clock lines 11 to 16, 21 to 26, 32, 34, and 36 may be significant. In case where the spacing between two neighboring clock lines is narrow, if signals having the same phase are applied to the clock lines, rising and falling timings of the signals are the same, and thus, signal distortion due to the coupling effect may not occur. However, when signals having different phases are applied to the clock lines, the rising and falling timings of the signals are different, causing signal distortion due to the coupling effect. As described above with reference to FIGS. 4 and 6, distortion of the scan-shift clocks SCCLK1 to SCCLK6 causes distortion of the scan control signals SCT (1) to SCT(7), which may directly affect image quality.

Figure 15:
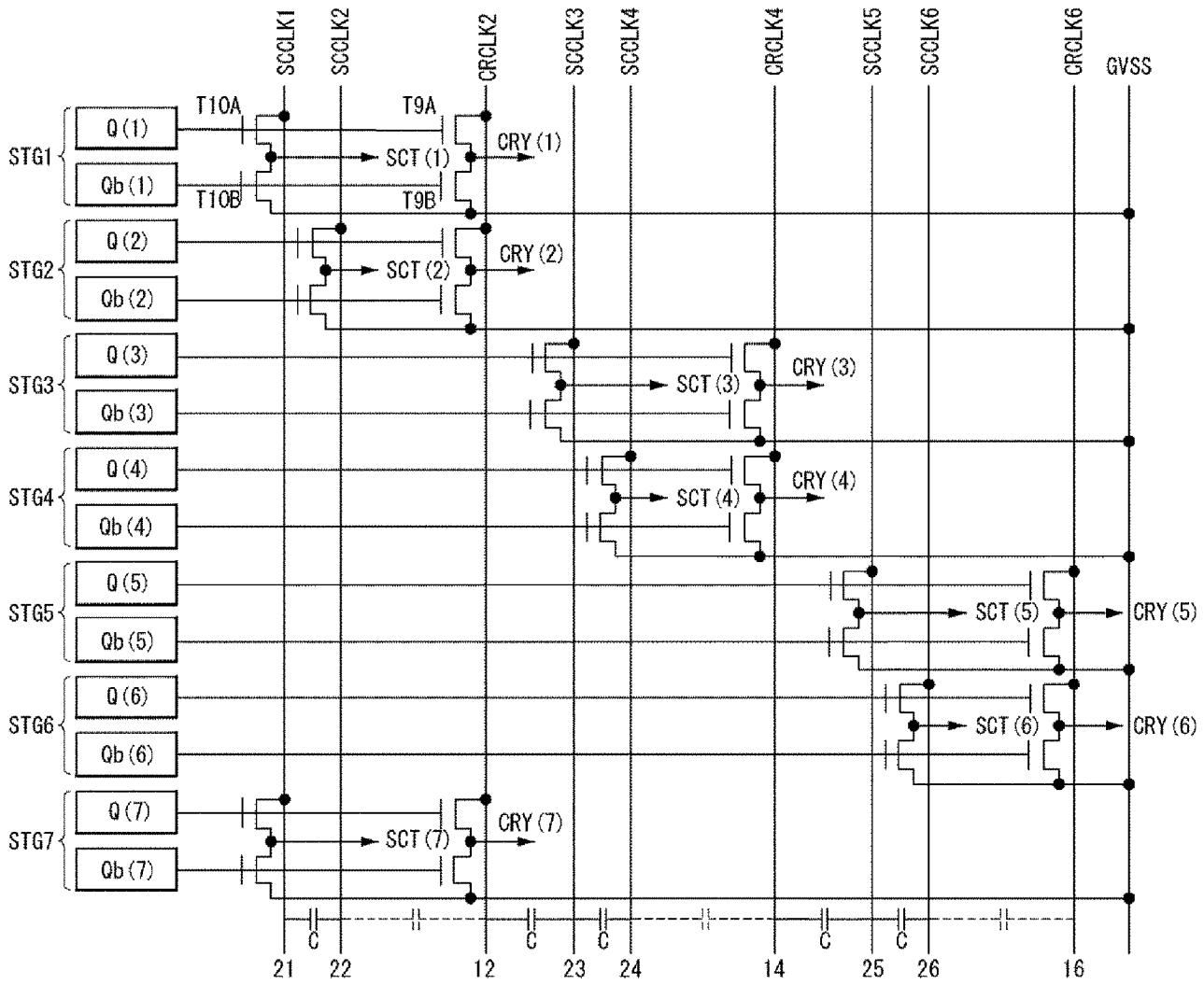
FIG. 15 is a view illustrating a modification of FIG. 7 for reducing a coupling effect between clock lines positioned on the gate-in-panel substrate.
Figure 16:
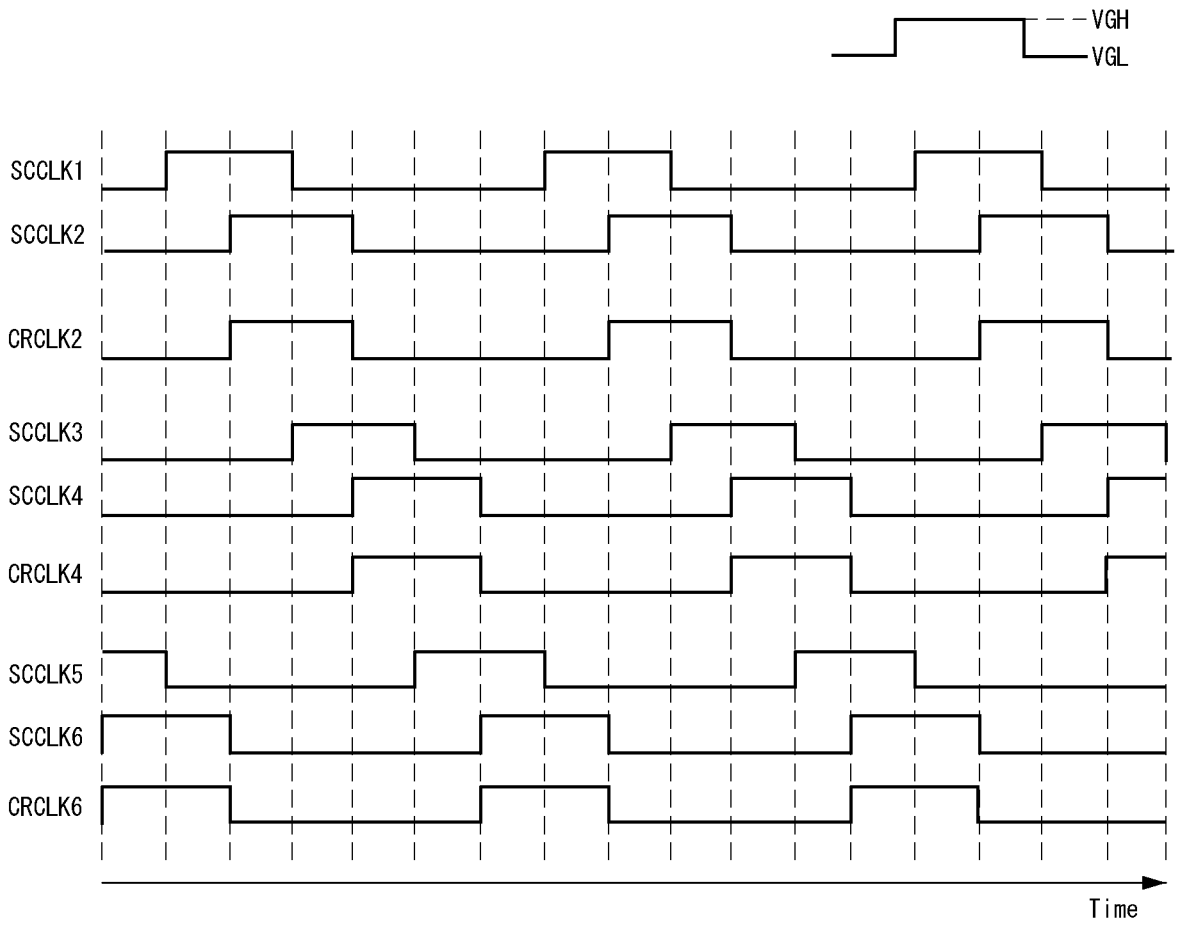
FIG. 16 is a view illustrating waveforms of shift clocks applied to the clock lines of FIG. 15.

FIG. 15 is a view illustrating a modification of FIG. 7 for reducing a coupling effect between clock lines positioned on the gate-in-panel substrate. FIG. 16 is a view illustrating waveforms of shift clocks applied to the clock lines of FIG. 15.

Referring to FIGS. 15 and 16, the gate shift register has a different arrangement order of clock lines, compared with that of FIG. 7, to minimize signal distortion due to coupling. That is, the shared carry clock lines 12, 14, and 16 may be disposed between the scan clock lines 21 to 26 so that the clock lines to which the in-phase clock signals are carried are disposed adjacent to each other. The shared carry clock lines 12, 14, and 16 on which one carry shift clock is carried are disposed adjacent to the scan clock lines to which a scan shift clock having the same phase as that of the carry shift clock is carried. For example, the shared carry clock line 12 to which the carry shift clock CRCLK2 is carried is disposed adjacent to the scan clock line 22 to which the scan shift clock SCCLK2 is carried, the shared carry clock line 14 to which the carry shift clock CRCLK4 is carried is disposed adjacent to the scan clock line 24 to which the scan shift clock SCCLK4 is carried, and the shared carry clock line 16 to which the carry shift clock CRCLK6 is carried is disposed to adjacent to the scan clock line 26 to which the scan shift clock SCCLK6 is carried.

In case where signals having the same phase are applied to the clock lines adjacent to each other, since the rising and falling timings of the signals are the same, signal distortion due to the coupling effect does not occur. Therefore, the present disclosure may realize a narrow bezel by narrowing the number of the clock lines and the spacing of clock lines and increase display quality by minimizing signal distortion through appropriate clock line arrangement. As noted, in one embodiment, the signal on the carry shift clocks CRCLK2, CRCLK4, and CRCLK6 fully overlap and therefore are the same as the signal on the even-numbered scan shift clocks SCCLK2, SCCLK4, and SCCLK6. In one embodiment for the layout of the circuit on the PCB 140, the conductive lines carrying the signal CRCLK2 AND SCCLK2 can be positioned adjacent to each other, and similarly for the other lines whose voltage levels and phases fully overlap. Since the same voltage level will be the same on both of them in the same timing sequence of the signals, the parasitic capacitive coupling will go to zero. Thus, the layout of the conductive lines on the PCB 140 can be selected to be at locations that reduce the capacitive coupling effect of the various clock signals. The layout of the clock lines is therefore selected to place the clock lines with the same voltage levels and the same phases closely adjacent to each other.

Figure 17:
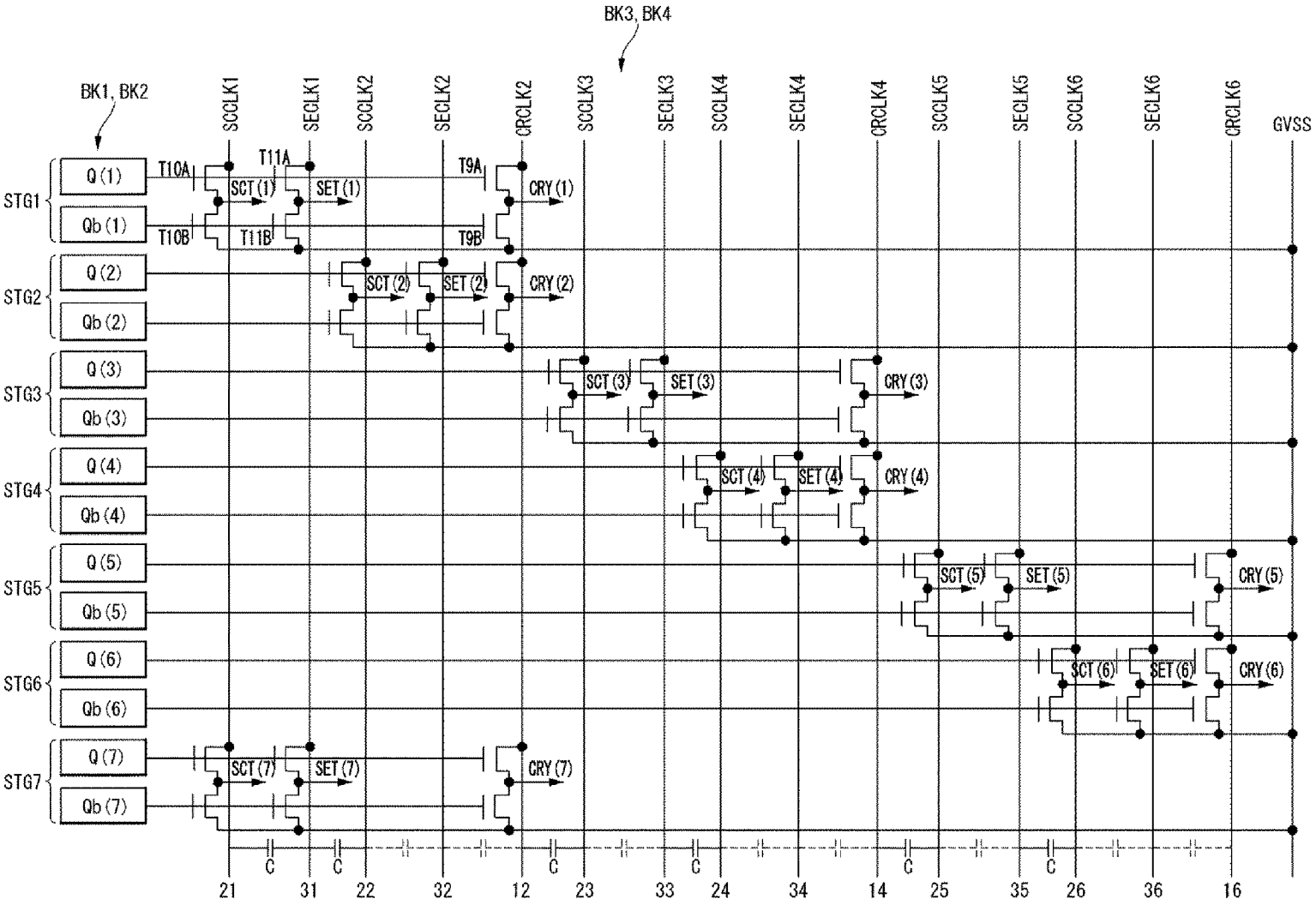
FIG. 17 is a view illustrating a modification of FIG. 9 for reducing a coupling effect between clock lines positioned on the gate-in-panel substrate.
Figure 18:
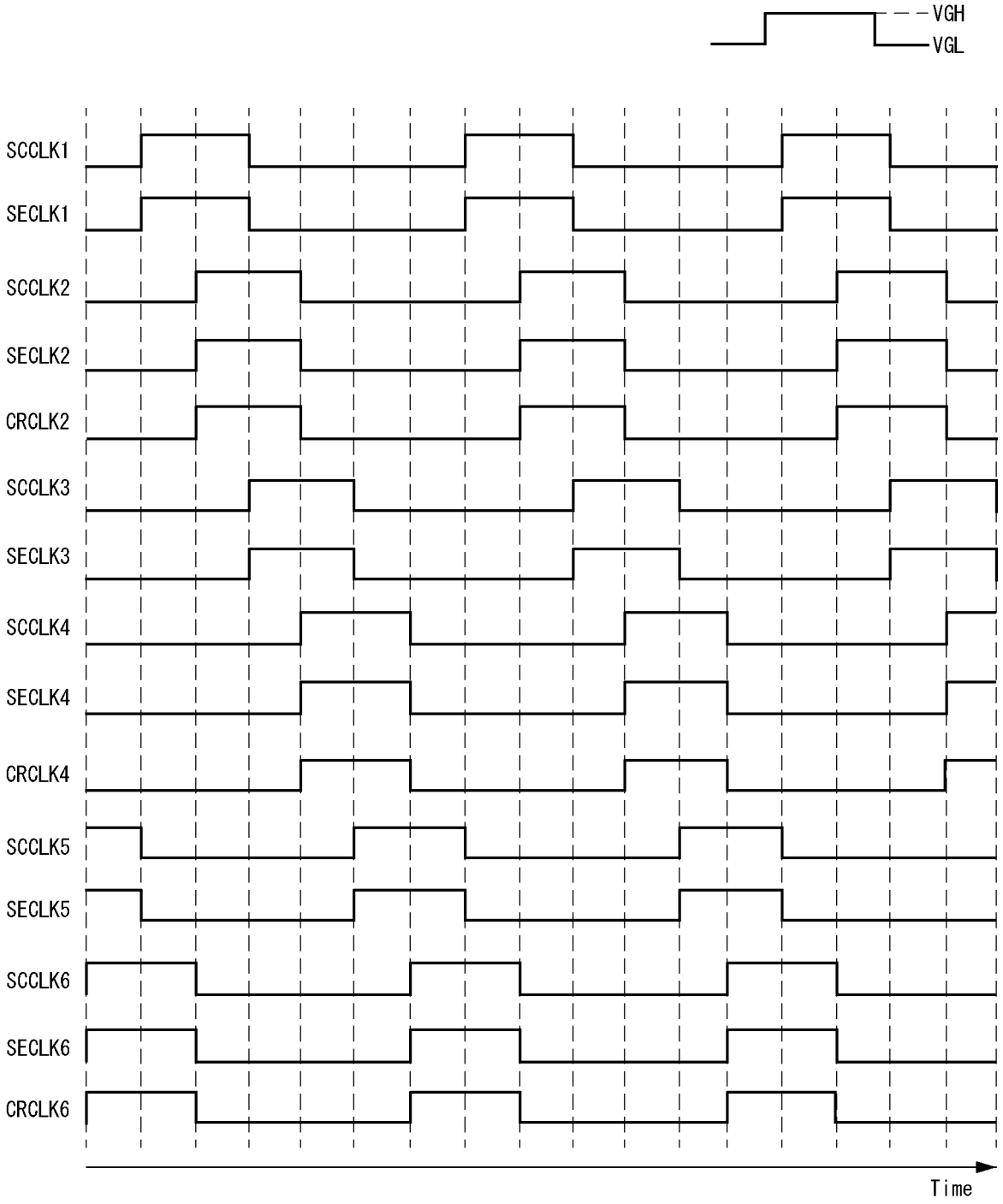
FIG. 18 is a view illustrating waveforms of shift clocks applied to the clock lines of FIG. 17.

FIG. 17 is a view illustrating a modification of FIG. 9 for reducing the coupling effect between clock lines positioned on the gate-in-panel substrate. FIG. 18 is a view illustrating waveforms of shift clocks applied to the clock lines of FIG. 17.

Referring to FIGS. 17 and 18, the gate shift register has a different arrangement order of clock lines, compared with that of FIG. 9, to minimize signal distortion due to coupling. That is, the shared carry clock lines 12, 14, and 16 may be disposed between the scan clock lines 21 to 26 and the sensing clock lines 31 to 36 so that the clock lines to which the in-phase clock signals are carried are disposed adjacent to each other. Namely, the sensing clock signals are carried on the sensing clock lines. Also, the scan clock lines 21 to 26 and the sensing clock lines 31 to 36 connected to the same stage may be disposed adjacent to each other.

Here, the shared carry clock lines 12, 14 and 16 to which one carry shift clock is carried are disposed adjacent to the scan clock lines to which a scan shift clock having the same phase as that of the carry shift clock or a sensing shift clock having the same phase as that of the carry shift clock is carried. For example, the shared carry clock line 12 to which the carry shift clock CRCLK2 is carried is disposed adjacent to the scan clock line 22 to which the scan shift clock SCCLK2 is carried or the sensing clock line 32 to which the sensing shift clock SECLK2 is carried, the shared carry clock line 14 to which the carry shift clock CRCLK4 is carried is disposed adjacent to the scan clock line 24 to which the scan shift clock SCCLK4 is carried or the sensing clock line 34 to which the sensing shift clock SECLK4 is carried, and the shared carry clock line 16 to which the carry shift clock CRCLK6 is carried is disposed adjacent to the scan clock line 26 to which the scan shift clock SCCLK6 is carried or the sensing clock line 36 to which the sensing shift clock SECLK6 is carried.

In case where signals having the same phase are applied to the clock lines adjacent to each other, rising and falling times of the signals are the same, and thus, signal distortion due to coupling does not occur. Accordingly, the present disclosure may realize a narrow bezel by narrowing the number of the clock lines and the spacing between the clock lines and improve display quality by minimizing signal distortion through appropriate clock line arrangement.

Figure 19:
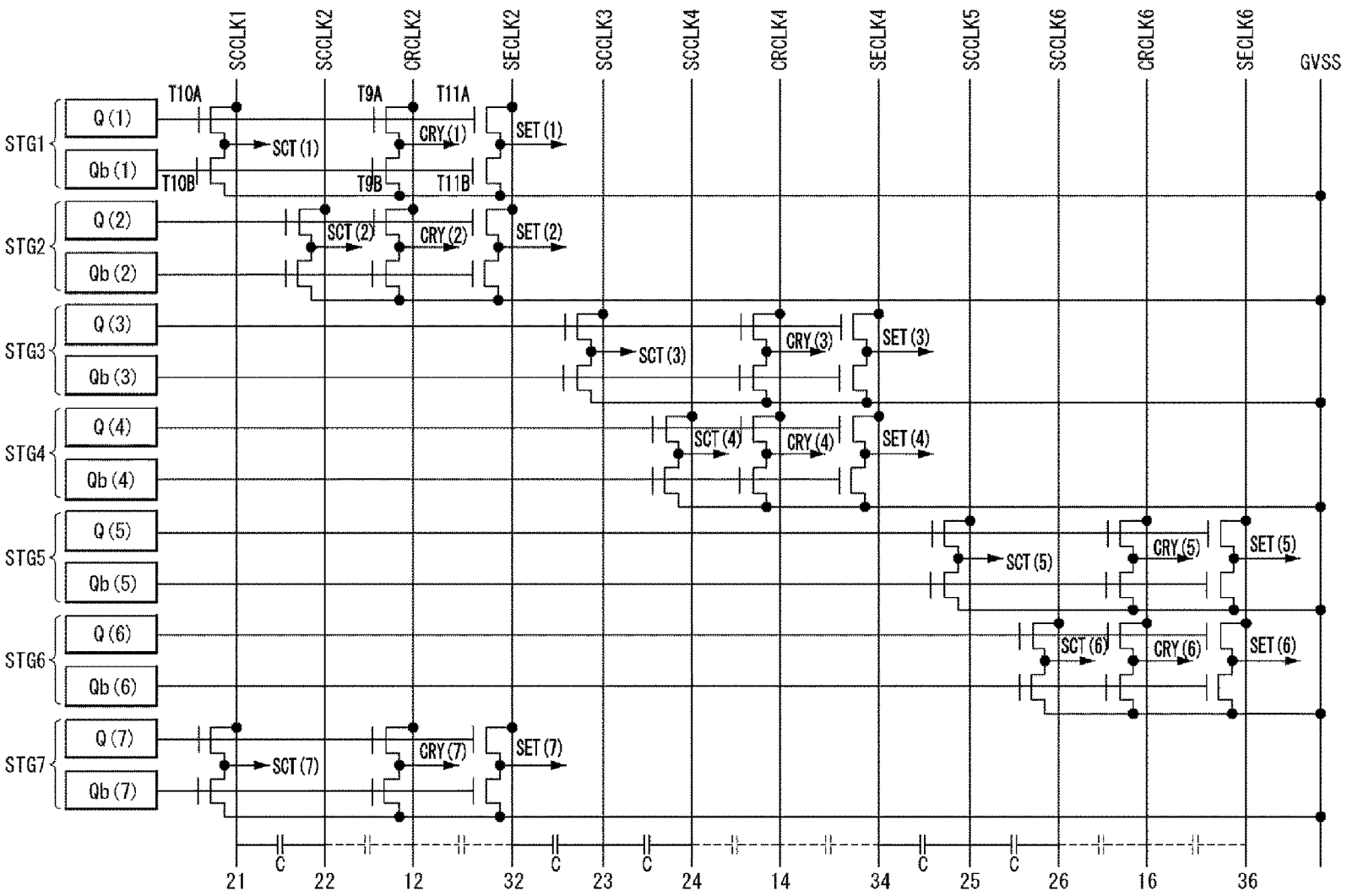
FIG. 19 is a view illustrating a modification of FIG. 11 for reducing a coupling effect between clock lines positioned on the gate-in-panel substrate.
Figure 20:
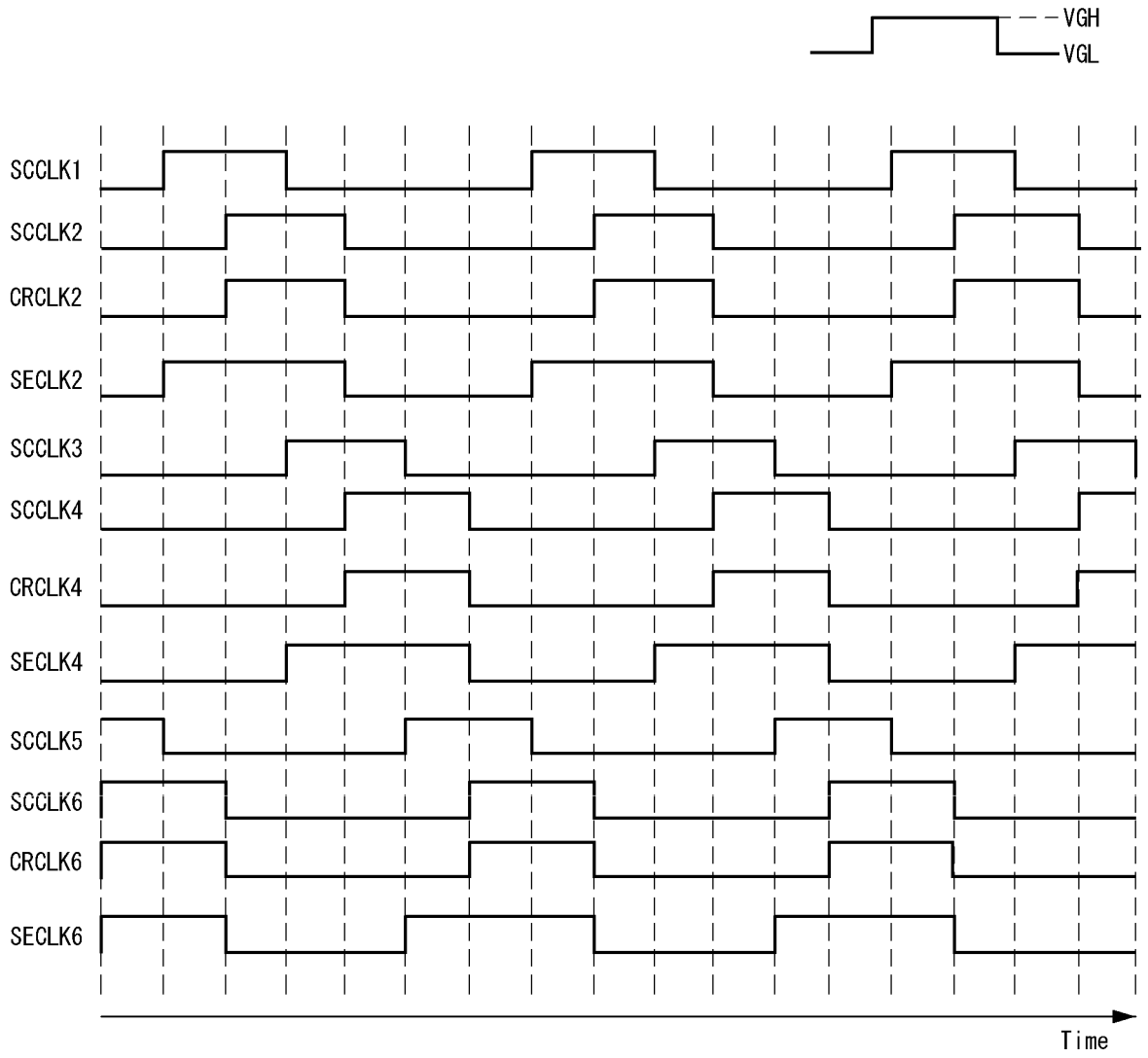
FIG. 20 is a view illustrating waveforms of shift clocks applied to the clock lines of FIG. 19.

FIG. 19 is a view illustrating a modification of FIG. 11 for reducing a coupling effect between clock lines positioned on the gate-in-panel substrate. FIG. 20 is a view illustrating waveforms of shift clocks applied to the clock lines of FIG. 19.

Referring to FIGS. 19 and 20, the gate shift register has a different arrangement order of clock lines, compared with that of FIG. 11, to minimize signal distortion due to coupling. That is, the shared carry clock lines 12, 14, 16 may be disposed between the scan clock lines 21 to 26 so that the clock lines to which the clock signals having the same phase are carried are arranged adjacent to each other. Here, the shared sensing clock lines 32, 34, and 36 to which one sensing shift clock is carried may be disposed adjacent to the shared carry clock lines 12, 14, and 16, respectively.

The shared carry clock lines 12, 14 and 16 to which one carry shift clock is carried are disposed adjacent to the scan clock lines to which a scan shift clock having the same phase as that of the carry shift clock is carried. For example, the shared carry clock line 12 to which the carry shift clock CRCLK2 is carried is disposed adjacent to the scan clock line 22 to which the scan shift clock SCCLK2 is carried, the shared carry clock line 14 to which the carry shift clock CRCLK4 is carried is disposed adjacent to the scan clock line 24 to which the scan shift clock SCCLK4 is carried, and the shared carry clock line 16 to which the carry shift clock CRCLK6 is carried is disposed adjacent to the scan clock line 26 to which the scan shift clock SCCLK6 is carried.

When signals of the same phase are applied to the clock lines adjacent to each other, signaling due to the coupling effect is not generated because the rising and falling timings of the signals are the same. Accordingly, the present disclosure may implement a narrow bezel by narrowing the number and spacing of clock lines and minimizing signal distortion through appropriate clock line arrangement, thereby improving display quality.

Figure 21:
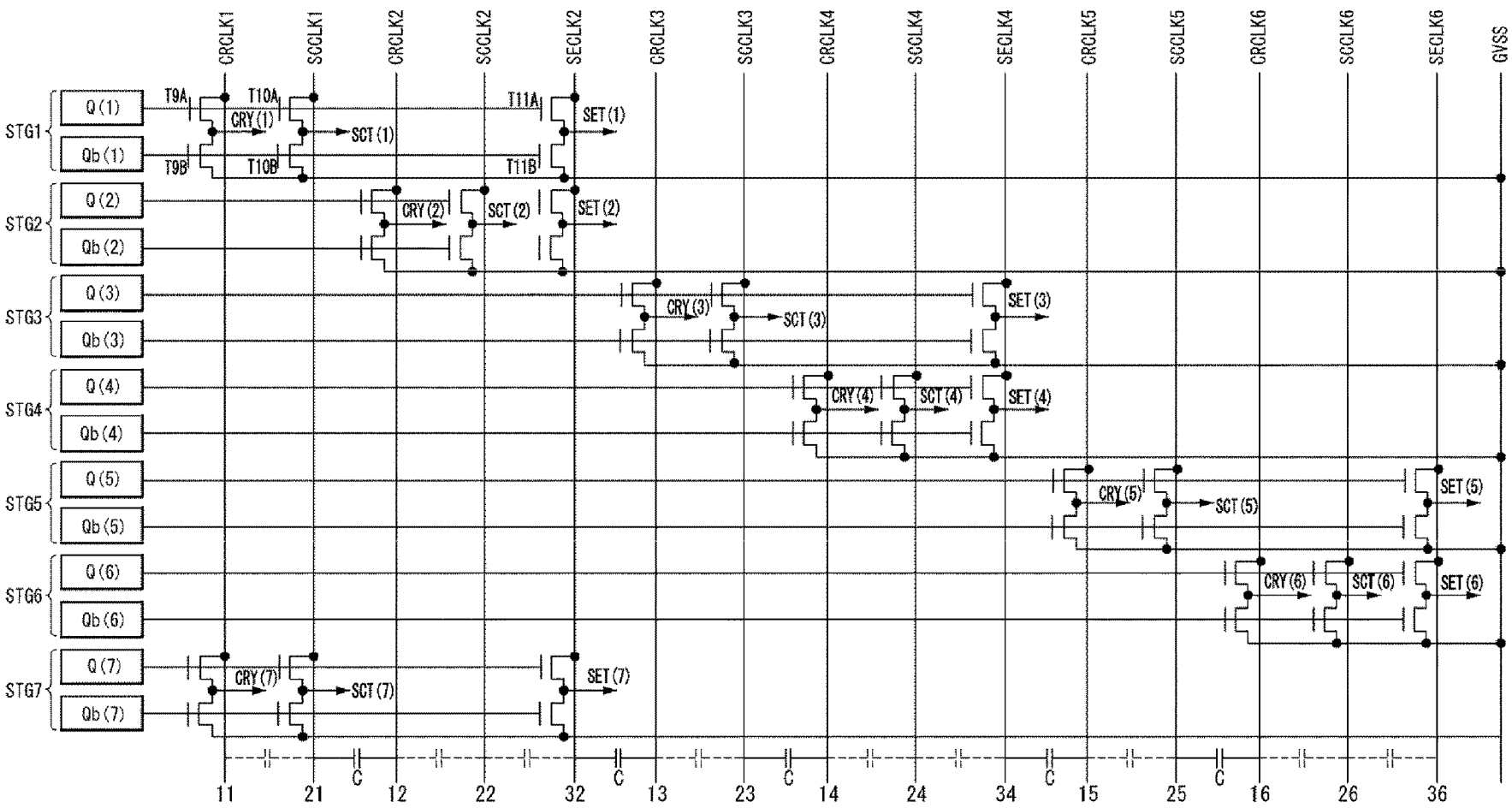
FIG. 21 is a view illustrating a modification of FIG. 13 for reducing a coupling effect between clock lines positioned on the gate-in-panel substrate.
Figure 22:
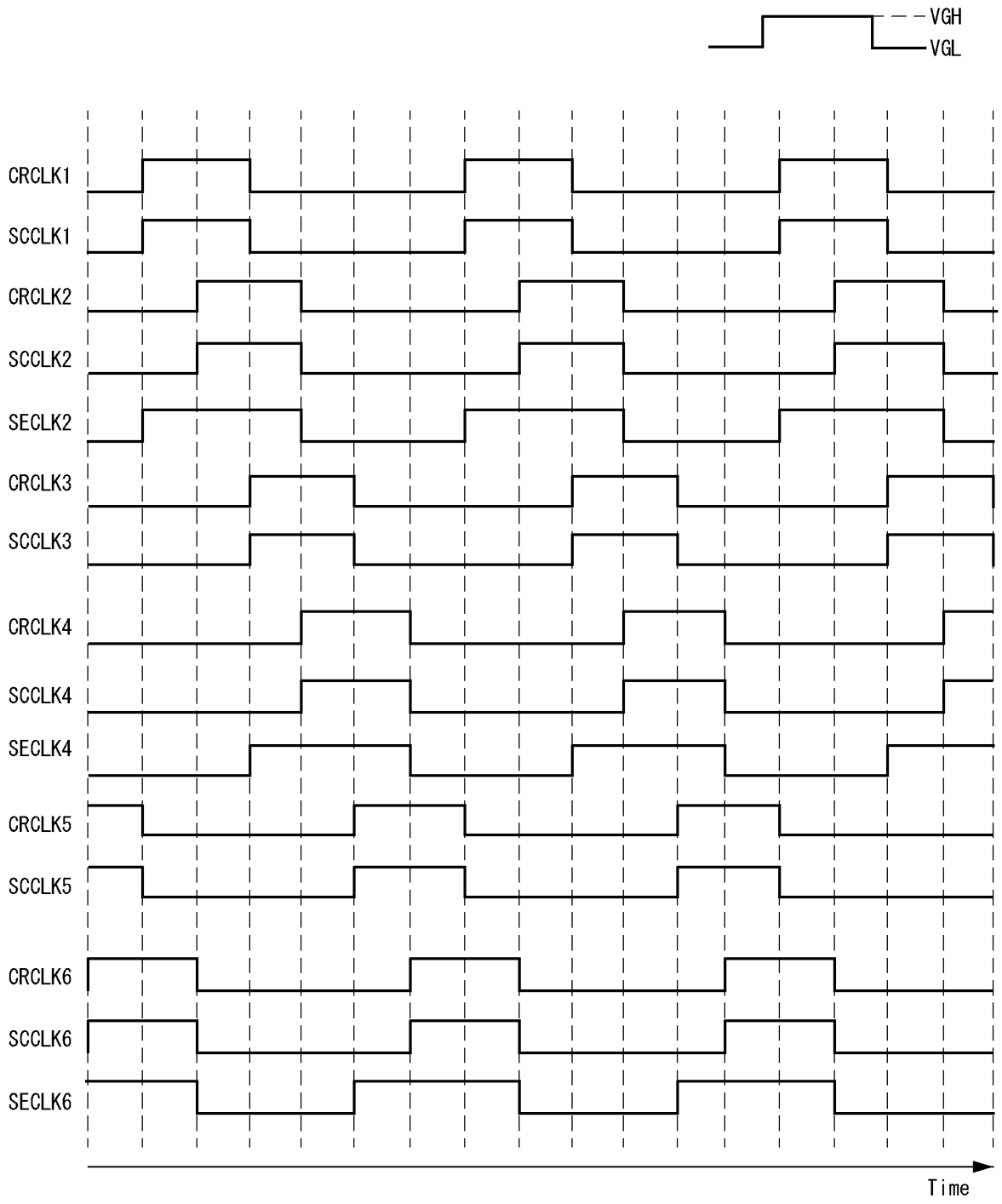
FIG. 22 is a view illustrating waveforms of shift clocks applied to the clock lines of FIG. 21.

FIG. 21 is a view illustrating a modification of FIG. 13 for reducing a coupling effect between clock lines positioned on the gate-in-panel substrate. FIG. 22 is a view illustrating waveforms of shift clocks applied to the clock lines of FIG. 21.

Referring to FIGS. 21 and 22, the gate shift register has a different arrangement order of clock lines, compared with that of FIG. 13, to minimize signal distortion due to coupling. That is, the carry clock lines 11 to 16 and the scan clock lines 21 to 26 connected to the same stage are disposed adjacent to each other so that the clock lines to which the clock signals having the same phase are carried are arranged adjacent to each other. Here, the shared sensing clock lines 32, 34, and 36 to which one sensing shift clock is carried may be disposed adjacent to the scan clock lines 22, 24, and 26, respectively.

The odd-numbered scan clock line carried with the odd-numbered scan shift clock and the odd-numbered carry clock line carried with the odd-numbered carry shift clock are disposed adjacent to each other, and the even-numbered scan clock line carried with the even-numbered scan shift clock and the even-numbered carry clock line carried with the even-numbered carry shift clock may be disposed adjacent to each other. Here, the odd-numbered scan shift clock and the odd-numbered carry shift clock are in phase, and the even-numbered scan shift clock and the even-numbered carry shift clock are in phase.

In case where signals having the same phase are applied to the clock lines adjacent to each other, since the rising and falling timings of the signals are the same, signal distortion due to the coupling effect does not occur. Therefore, the present disclosure may realize a narrow bezel by narrowing the number of the clock lines and the spacing of clock lines and increase display quality by minimizing signal distortion through appropriate clock line arrangement.

As described above, the present disclosure may realize a narrow bezel by reducing the number of carry clock lines and/or the sensing clock lines.

Further, according to the present disclosure, the clock lines supplying the clock signals having the same phase are arranged adjacent to each other to reduce or completely suppress the coupling effect, thereby minimizing distortion of the shift clocks due to the coupling effect and improving image quality.

In the above exemplary systems, although the methods have been described on the basis of the flowcharts using a series of the steps or blocks, the present disclosure is not limited to the sequence of the steps, and some of the steps may be performed at different sequences from the remaining steps or may be performed simultaneously with the remaining steps. Furthermore, those skilled in the art will understand that the steps shown in the flowcharts are not exclusive and may include other steps or one or more steps of the flowcharts may be deleted without affecting the scope of the present disclosure.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A display device comprising:

a gate-in-panel substrate; a gate shift register having a plurality of stages positioned on the gate-in-panel substrate, two stages of the plurality of stages adjacent to each other being a pair of stages;

a plurality of individual scan clock lines positioned on the gate-in-panel substrate, each of the scan clock lines supplying scan shift clocks; and a plurality of shared carry clock lines positioned on the gate-in-panel substrate, each of the shared carry clock lines supplying a shared carry shift clock to two different stages of the gate shift register for generating a respective carry signal to each of the two stages;

wherein a scan clock line of the plurality and a shared carry clock line of the plurality are positioned adjacent to each other on the gate-in-panel substrate, wherein a first phase of a first scan shift clock supplied from the scan clock line and a second phase of a first shared carry shift clock supplied from the shared carry clock line are equal to each other, and wherein each pair of stages including an odd-numbered stage and an even-numbered stage positioned adjacent to each other receives one shared carry shift clock.

2. The display device of claim 1 further comprising:

a plurality of individual sensing clock lines positioned on the gate-in-panel substrate, each of the individual sensing clock lines supplying a sensing shift clock to a pair of adjacent shift register stages.

3. The display device of claim 2 wherein a scan clock line of the plurality, and the individual sensing clock line of the plurality that have fully overlapping phases of their respective signals are positioned adjacent to each other on the gate-in-panel substrate.

4. The display device of claim 2 wherein a scan clock line of the plurality, the individual sensing clock line of the plurality and a shared carry clock line of the plurality that have fully overlapping phases of their respective signals are positioned adjacent to each other on the gate-in-panel substrate.

5. The display device of claim 2, wherein the number of the shared carry clock lines is half of the number of the scan clock lines and is half of the number of the individual sensing clock lines.

6. A display device comprising:

a gate-in-panel substrate;

a gate shift register having a plurality of stages positioned on the gate-in-panel substrate, two stages of the plurality of stages adjacent to each other being a pair of stages;

a plurality of scan clock lines positioned on the gate-in-panel substrate, each of the scan clock lines supplying scan shift clocks having different phases for generating a scan control signal to the stages; and a plurality of carry clock lines positioned on the gate-in-panel substrate, each of the carry clock lines supplying carry shift clocks having different phases with each other for generating respective carry signals to the stages, wherein each pair of stages including an odd-numbered stage and an even-numbered stage adjacent to each other receives one carry shift clock, and wherein the number of the carry clock lines is half of the number of the scan clock lines.

7. The display device of claim 6 wherein at least one of the carry clock lines carries the carry signal that is in phase and has the same voltage level of at least one of the scan clock lines.

8. The display device of claim 6 wherein the carry clock line that carries a signal that is fully in phase and has the same voltage level of the scan clock lines are positioned adjacent to each other on the gate-in-panel substrate.

9. The display device of claim 6 wherein the carry clock line that carries a signal that is partially in phase and has a same voltage level as one of the scan clock lines are positioned adjacent to each other on the gate-in-panel substrate.

10. The display device of claim 6 further including:

a plurality of sensing clock lines positioned on the gate-in-panel substrate, each of the sensing clock lines having different phases for generating a sensing signal to the stages.

11. The display device of claim 10 wherein the number of the sensing clock lines is half of the number of the scan clock lines.

12. The display device of claim 10 wherein at least one of the sensing clock lines carries the sensing signal that is in phase and has the same voltage level of at least one of the scan clock lines.

13. The display device of claim 10 wherein the sensing clock line that carries the sensing signal that is fully in phase and has the same voltage level as one of the scan clock lines are positioned adjacent to each other on the gate-in-panel substrate.

14. The display device of claim 10 wherein at least one of the sensing clock lines carries the sensing signal that is in phase and has the same voltage level of at least one of the scan clock lines and at least one of the carry clock lines.

15. The display device of claim 10 wherein the three clock lines of the sensing clock line, the scan clock line and the carry clock line that carry a signal that is fully in phase and has the same voltage level as each other are positioned adjacent to each other on the gate-in-panel substrate.

16. A display device comprising:

a gate-in-panel substrate;

a gate shift register having a plurality of stages positioned on the gate-in-panel substrate, two stages of the plurality of stages adjacent to each other being a pair of stages;

a plurality of scan clock lines positioned on the gate-in-panel substrate, each of the scan clock lines carrying scan shift clocks having different phases for generating a scan control signal to the stages; and a plurality of carry clock lines positioned on the gate-in-panel substrate, each of the carry clock lines carrying carry shift clocks having different phases with each other for generating respective carry signals to the stages, wherein at least one of the carry clock lines carries a first carry shift clock, and at least one of the scan clock lines carries a first scan shift clock and wherein a first phase of the first carry shift clock and a second phase of the first scan shift clock are equal to each other.

17. The display device of claim 16 wherein the carry clock lines and the scan clock lines that each carry a signal is fully in phase with each other and are positioned adjacent to each other on the gate-in-panel substrate.

18. The display device of claim 17 wherein the signal that is on the carry clock line that is adjacent to the scan clock line also has the same voltage as the signal on the scan clock line.

19. The display device of claim 16 further including:

a plurality of sensing clock lines positioned on the gate-in-panel substrate, each of the sensing clock lines having different phases for generating a sensing signal to the stages.

20. The display device of claim 19 wherein the sensing clock line that carries the sensing signal that is fully in phase and has the same voltage level as one of the scan clock lines are positioned adjacent to each other on the gate-in-panel substrate.

* * * * *